US012196482B2

(12) United States Patent
Lee et al.

(10) Patent No.: US 12,196,482 B2
(45) Date of Patent: Jan. 14, 2025

(54) REFRIGERATOR

(71) Applicant: SAMSUNG ELECTRONICS CO., LTD., Suwon-si (KR)

(72) Inventors: Seungmin Lee, Suwon-si (KR); Jehun Kang, Suwon-si (KR); Joongho Kim, Suwon-si (KR); Sungun Go, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 255 days.

(21) Appl. No.: 17/860,324

(22) Filed: Jul. 8, 2022

(65) Prior Publication Data

US 2023/0077776 A1 Mar. 16, 2023

Related U.S. Application Data

(63) Continuation of application No. PCT/KR2022/008981, filed on Jun. 23, 2022.

(30) Foreign Application Priority Data

Sep. 10, 2021 (KR) ..... 10-2021-0121302
Jan. 27, 2022 (KR) ..... 10-2022-0012688

(51) Int. Cl.
*F25D 23/06* (2006.01)

(52) U.S. Cl.
CPC ..... *F25D 23/063* (2013.01)

(58) Field of Classification Search
CPC ..... F25D 23/063; F25D 11/02; F25D 19/00; F25D 23/06; F25D 23/064; F25D 25/02; F25D 23/066; F16B 5/06
See application file for complete search history.

(56) References Cited

U.S. PATENT DOCUMENTS 5,647,181 A * 7/1997 Hunts ..... A63H 33/10 312/265.5
8,245,524 B2 8/2012 Kuehl
(Continued)

FOREIGN PATENT DOCUMENTS

CN 107084588 A 8/2017
CN 209978486 1/2020
(Continued)

OTHER PUBLICATIONS

International Search Report dated Oct. 13, 2022 in International Patent Application No. PCT/KR2022/008981 (3 pages; 4 pages English translation).
(Continued)

*Primary Examiner* — Hanh V Tran
(74) *Attorney, Agent, or Firm* — STAAS & HALSEY LLP

(57) ABSTRACT

A refrigerator includes: an inner case including a plurality of plates formed by injection-molding; an outer case couplable with an exterior of the inner case; and an insulation between the inner case and the outer case. A first plate of the plurality of plates includes a first coupling portion formed along an edge of the first plate, and a second plate of the plurality of plates includes a second coupling portion formed along an edge of the second plate and couplable with the first coupling portion. The first coupling portion includes an insertion protrusion. The second coupling portion includes: an accommodating portion forming an accommodating groove in which the insertion protrusion is inserted; and a catching portion configured to prevent the insertion protrusion from departing from the accommodating groove; and an inner rib protruding from an inner surface of the accommodating portion to be inserted in the insertion groove.

20 Claims, 23 Drawing Sheets

(56) References Cited

U.S. PATENT DOCUMENTS

| | | | | |
|---|---|---|---|---|
| 8,336,321 | B2 | 12/2012 | Cur et al. | |
| 8,453,476 | B2 | 6/2013 | Kendall et al. | |
| 8,739,568 | B2 | 6/2014 | Allard et al. | |
| 9,308,677 | B2 * | 4/2016 | Lee | F25D 23/028 |
| 10,808,989 | B2 | 10/2020 | Yoon et al. | |
| 10,907,885 | B2 * | 2/2021 | Jung | F25D 23/067 |
| 11,346,592 | B2 | 5/2022 | Seo et al. | |
| 11,415,363 | B2 | 8/2022 | Lim et al. | |
| 11,566,785 | B2 * | 1/2023 | Ma | F21V 33/0044 |
| 11,761,699 | B2 * | 9/2023 | Jung | F25D 23/065 312/406 |
| 2018/0180350 | A1 * | 6/2018 | Yoon | F25D 23/066 |
| 2018/0187957 | A1 * | 7/2018 | Jung | F25D 23/062 |
| 2018/0187961 | A1 * | 7/2018 | Lim | F25D 27/00 |
| 2020/0200466 | A1 * | 6/2020 | Hwang | F25D 19/00 |
| 2023/0258391 | A1 * | 8/2023 | Park | F25D 23/063 220/592.09 |

FOREIGN PATENT DOCUMENTS

| | | | | |
|---|---|---|---|---|
| CN | 211372914 | U | 8/2020 | |
| EP | 3339781 | A1 * | 6/2018 | B21D 5/00 |
| JP | 4277675 | | 3/2009 | |
| JP | 2015-200458 | | 11/2015 | |
| KR | 0122415 | | 5/1998 | |
| KR | 10-0374559 | | 3/2003 | |
| KR | 10-2005-0119464 | | 12/2005 | |
| KR | 10-0555702 | | 3/2006 | |
| KR | 10-0700612 | | 3/2007 | |
| KR | 10-2007-0042059 | | 4/2007 | |
| KR | 10-0864724 | | 10/2008 | |
| KR | 20090105331 | A * | 10/2009 | |
| KR | 10-1324189 | | 11/2013 | |
| KR | 10-1455855 | | 11/2014 | |
| KR | 10-1608503 | | 4/2016 | |
| KR | 10-2017-0024765 | | 3/2017 | |
| KR | 10-1709707 | | 3/2017 | |
| KR | 10-2018-0066497 | | 6/2018 | |
| KR | 10-1872074 | | 6/2018 | |
| KR | 10-2018-0080054 | | 7/2018 | |
| KR | 10-2018-0080082 | | 7/2018 | |
| KR | 101902247 | B1 * | 9/2018 | |
| KR | 10-2019-0013767 | | 2/2019 | |
| KR | 10-2036968 | | 10/2019 | |
| KR | 10-2020-0095867 | | 8/2020 | |
| KR | 10-2020-0121110 | | 10/2020 | |
| KR | 10-2020-0140512 | | 12/2020 | |
| WO | WO-2022131721 | A1 * | 6/2022 | B29C 45/14 |

OTHER PUBLICATIONS

PCT/ISA/237 dated Oct. 13, 2022 in International Patent Application. No. PCT/KR2022/008981 (5 pages).

Korean Office Action dated Apr. 5, 2024 for Korean Application No. 10-2022-0012688.

Extended European Search Report dated Jul. 31, 2024 for European Application No. 22867515.3.

* cited by examiner

REFRIGERATOR

CROSS-REFERENCE TO RELATED APPLICATION

This application is a continuation application, under 35 U.S.C. § 111(a), of International Application No. PCT/KR2022/008981, filed on Jun. 23, 2022, which is based on and claims priority under 35 U.S.C. § 119 to Korean Patent Applications No. 10-2021-0121302, filed on Sep. 10, 2021, and 10-2022-0012688, filed on Jan. 27, 2022 in the Korean Intellectual Property Office, the disclosures of which are incorporated by reference herein in their entireties.

BACKGROUND

1. Field

The disclosure relates to a refrigerator, and more particularly, to a refrigerator with an inner case formed by assembling a plurality of plates formed by injection-molding.

2. Description of the Related Art

A refrigerator is a home appliance that includes a main body having a storage room, and a cool air supplier for supplying cool air to the storage room to keep foods fresh. The storage room includes a refrigerating room that is maintained at about 0° C. to 5° C. to keep foods refrigerated and a freezing room that is maintained at about 0° C. to 30° C. below zero to keep foods frozen. The front side of the storage room opens to put food in or take food out, and the open front side of the storage room is opened or closed by doors.

The main body of the refrigerator is formed by coupling an inner case with an outer case. The inner case forms the storage room, and the outer case forms the outer appearance of the refrigerator. An insulation is positioned between the inner case and the outer case to insulate the storage room.

SUMMARY

According to a concept of the disclosure, a refrigerator includes: an inner case forming a storage room and including a plurality of plates, each of the plurality of plates formed by injection-molding; an outer case couplable with an exterior surface of the inner case; and an insulation provided between the inner case and the outer case, wherein a first plate of the plurality of plates includes a first coupling portion formed along an edge of the first plate, the first coupling portion comprises an insertion protrusion, and a second plate of the plurality of plates comprises a second coupling portion formed along an edge of the second plate and couplable with the first coupling portion, the second coupling portion includes: an accommodating portion formed to have an accommodating groove into which the insertion protrusion is insertable, a catching portion configured to prevent the insertion protrusion from departing from the accommodating groove upon insertion of the insertion protrusion into the accommodating groove, and an inner rib formed to protrude from an inner surface of the accommodating portion toward the accommodating groove and insertable into the insertion groove.

The accommodating portion may include: a first wall; a second wall being opposite to the first wall; and a third wall connecting the first wall to the second wall, and the inner rib formed to protrude from the third wall.

The first wall is formed to protrude from the second plate toward the insulation.

The insertion protrusion insertable into the accommodating groove in a first direction, the inner rib formed to protrude along a second direction that is opposite to the first direction, the inner rib supported by the insertion protrusion along a fourth direction that is opposite to the third direction upon thermal contraction of the second plate along a third direction that is perpendicular to the first direction.

The inner rib formed to extend along a longitudinal direction of the edge of the second plate.

The insertion protrusion may include: a first surface corresponding to the first wall; a second surface corresponding to the second wall; and a third surface corresponding to the third wall.

The insertion protrusion may include a catching hook formed to protrude from the second surface and configured to be caught by the catching portion.

The insertion protrusion may include a rib groove into which the inner rib is insertable, and the rib groove formed by being depressed into the third surface.

The insertion protrusion may include a guide pin formed in the rib groove and configured to guide the insertion protrusion to be insertable into the accommodating groove, and the inner rib comprises a guide groove into which the guide pin is insertable.

The second coupling portion may include an outer rib connecting an outer surface of the second plate to an outer surface of the first wall and supporting the first wall.

The outer rib may include: a first contact surface being in contact with the outer surface of the second plate; a second contact surface being in contact with the outer surface of the first wall; and an inclined surface connecting the first contact surface to the second contact surface.

A plurality of outer ribs may be provided, and the plurality of outer ribs are spaced from each other along a longitudinal direction of the edge of the second plate.

The first wall is formed to extend from the second plate.

The first coupling portion may further include an auxiliary protrusion formed at an opposite side of the insertion protrusion, and the second coupling portion may further include a step portion stepped toward the insulation and being in contact with the auxiliary protrusion.

The second coupling portion may include an elastic bracket in which the catching portion is formed, and a plurality of slits respectively formed on both sides of the elastic bracket to enable the elastic bracket to be elastically deformable, the elastic bracket is, upon inserting of the insertion protrusion into the accommodating groove, pressed by the catching hook and elastically deformed, and the elastic bracket may return to an original state after the insertion protrusion is inserted in the accommodating groove.

In another aspect, according to a concept of the disclosure, a refrigerator includes: an inner case forming a refrigerating room and including a plurality of plates, each of the plurality of plates formed by injection-molding; an outer case couplable with an exterior surface of the inner case; and an insulation provided between the inner case and the outer case, wherein a first plate of the plurality of plates includes a first coupling portion formed along an edge of the first plate, the first coupling portion comprises an insertion protrusion, and a second plate of the plurality of plates includes a second coupling portion formed along an edge of the second plate and couplable with the first coupling portion, the second coupling portion includes: an accommodating portion formed to have an accommodating groove into which the insertion protrusion is insertable, the accommodating portion including a first wall, a second wall being opposite to the first wall, and a third wall connecting the first wall to the second wall, a catching portion configured to prevent the insertion protrusion from departing from the accommodating groove upon insertion protrusion into the accommodating groove, and an outer rib connecting the second plate to the first wall.

The outer rib may include: a first contact surface in contact with an outer surface of the second plate; a second contact surface in contact with an outer surface of the first wall; and an inclined surface connecting the first contact surface to the second contact surface.

A plurality of outer ribs may be provided, and the plurality of outer ribs may be spaced from each other along a longitudinal direction of the edge of the second plate.

In another aspect, according to a concept of the disclosure, a refrigerator includes: an inner case forming a storage room and including a plurality of plates, each of the plurality of plates formed by injection-molding; an outer case couplable with an exterior surface of the inner case; and an insulation provided between the inner case and the outer case, wherein a first plate of the plurality of plates includes a rail slidably supporting a storage container and a first coupling portion formed along an edge of the first plate, a second plate of the plurality of plates includes a second coupling portion formed along an edge of the second plate and coupleable with the first coupling portion, the first coupling portion and the second coupling portion are positioned below the rail, and a length from the outer case to the first coupling portion and the second coupling portion is greater than a length from the outer case to the rail.

In another aspect, according to a concept of the disclosure, a refrigerator includes: a main body including an inner case including a plurality of plates, each of the plurality of plates formed by injection-molding and forming a storage room, an outer case couplable with an exterior of the inner case, and an insulation provided between the inner case and the outer case; and a machine room provided in a rear, lower space of the main body, wherein a compressor is installable in the machine room, wherein the plurality of plates include an upper plate, a lower plate, a left plate, a right plate, and a rear plate, the lower plate includes a first coupling portion formed along an edge of the lower plate, and the rear plate includes a second coupling portion formed in an edge of the rear plate and coupleable with the first coupling portion, and an inner case round portion rounded convexly toward the machine room and formed to extend from the second coupling portion.

BRIEF DESCRIPTION OF THE DRAWINGS

The above and other aspects, features, and advantages of certain embodiments of the present disclosure will become more apparent from the following description taken in conjunction with the accompanying drawings of which.

DETAILED DESCRIPTION

The embodiments described in the present specification are only the most preferred embodiments of the disclosure but do not represent for the entire technical spirit of the disclosure. Thus, it should be understood that various equivalents or modification examples capable of replacing the embodiments of the disclosure are included in the scope of rights of the disclosure at the time when the present application was filed.

It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

it will be understood that, although the terms including ordinal numbers, such as "first", "second", etc., may be used herein to describe various components, these components should not be limited by these terms. These terms are only used to distinguish one component from another.

Therefore, it is an aspect of the disclosure to provide a refrigerator with an inner case formed by assembling a plurality of plates formed by injection-molding.

It is another aspect of the disclosure to provide a refrigerator capable of preventing or reducing a gap between a plurality of plates assembled to form an inner case.

It is another aspect of the disclosure to provide a refrigerator capable of improving airtightness between a plurality of plates assembled to form an inner case.

Additional aspects of the disclosure will be set forth in part in the description which follows and, in part, will be obvious from the description, or may be learned by practice of the disclosure.

Hereinafter, the preferred embodiments of the disclosure will be described in detail with reference to the accompanying drawings.

Figure 1:
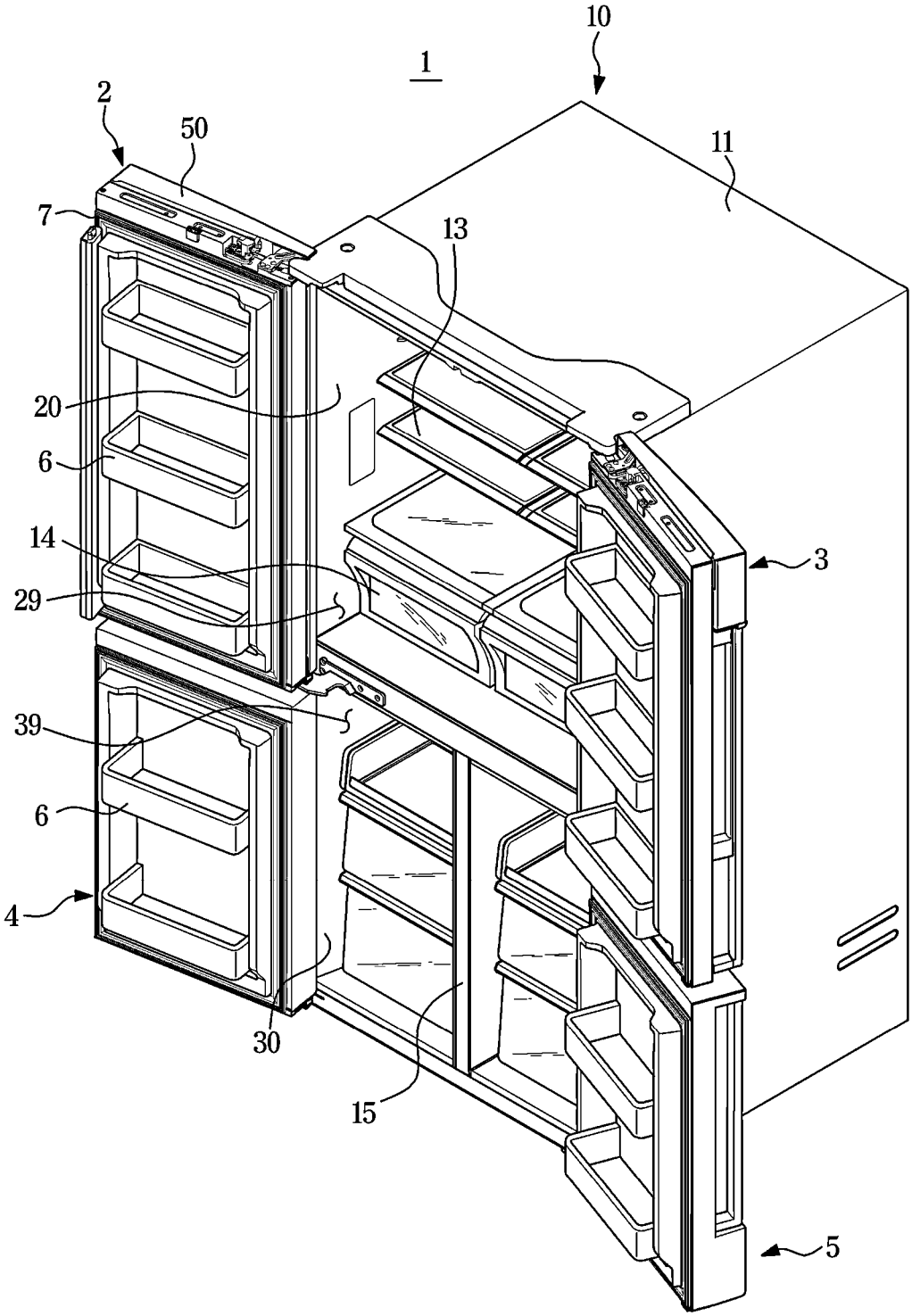
FIG. 1 shows an outer appearance of a refrigerator according to an embodiment of the disclosure.
Figure 2:
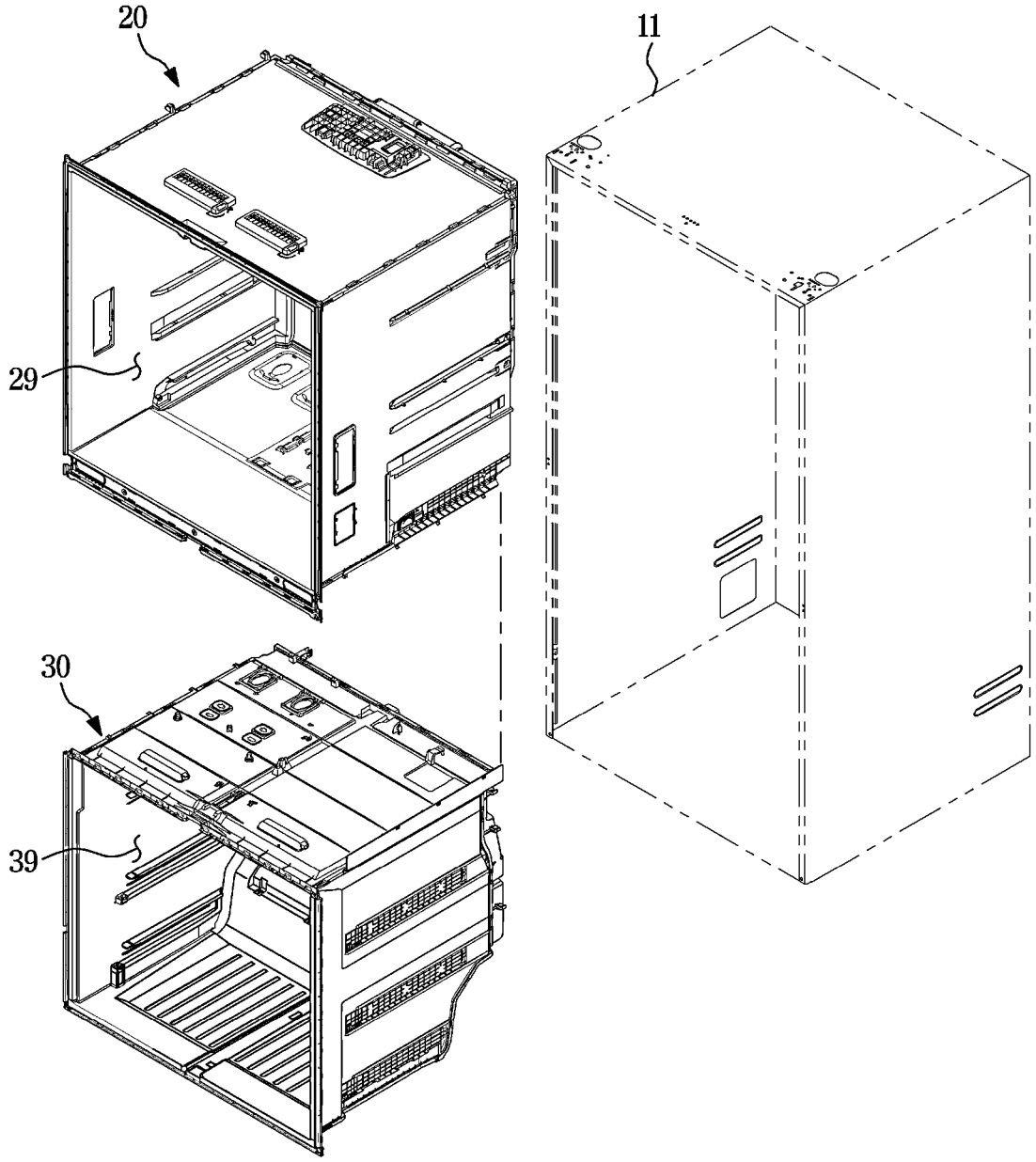
FIG. 2 is an exploded view of a first inner case, a second inner case, and an outer case of a refrigerator according to an embodiment of the disclosure.

FIG. 1 shows an outer appearance of a refrigerator according to an embodiment of the disclosure. FIG. 2 is an exploded view of a first inner case, a second inner case, and an outer case of a refrigerator according to an embodiment of the disclosure.

Referring to FIGS. 1 and 2, a refrigerator 1 may include a main body 10, a plurality of storage rooms 29 and 39 formed inside the main body 10, a plurality of doors 2, 3, 4, and 5 opening and closing the storage rooms 29 and 39, and a cool air supplier (not shown) for supplying cool air to the storage rooms 29 and 39.

The main body 10 may include a plurality of inner cases 20 and 30 forming the storage rooms 29 and 39, an outer case 11 coupled with outer sides of the inner cases 20 and 30 and forming an outer appearance, and an insulation 12 (see FIG. 6) provided between the inner cases 20 and 30 and the outer case 11 to insulate the storage rooms 29 and 39.

The cool air supplier may generate cool air by using a cooling circulation cycle of compressing, condensing, expanding, and evaporating a refrigerant, and supply the generated cool air to the storage rooms 29 and 39.

The inner cases 20 and 30 may include a first inner case 20 and a second inner case 30. The first inner case 20 and the second inner case 30 may be manufactured as separate components and then coupled with each other. Each of the first inner case 20 and the second inner case 30 may be in a shape of a box of which a front side opens.

A first storage room 29 may be formed inside the first inner case 20, and a second storage room 39 may be formed inside the second inner case 30. The first storage room 29 may be used as a refrigerating room, and the second storage room 39 may be used as a freezing room. The second storage room 39 may be partitioned into a plurality of rooms by a vertical partition wall 15. The vertical partition wall 15 may be manufactured separately from the second inner case 30 and then coupled with the second inner case 30. However, the above-described partitioning and use purposes of the storage rooms 29 and 39 are an example, and the storage rooms 29 and 30 are not limited to the above-described example.

The first inner case 20 may be positioned in an upper portion of the main body 10, and the second inner case 30 may be positioned in a lower portion of the main body 10. However, the positions of the first inner case 20 and the second inner case 30 are not limited to the current embodiment of the disclosure, and the first inner case 20 and the second inner case 30 may be arranged in a left-right direction.

Inside the storage rooms 29 and 39, a shelf 13 on which foods are put and a storage container 14 for storing foods may be provided.

The first storage room 29 may be opened and closed by a pair of doors 2 and 3. The doors 2 and 3 may be rotatably coupled with the main body 10. The second storage room 39 may be opened and closed by the doors 4 and 5, and the doors 4 and 5 may be rotatably coupled with the main body 10. On rear surfaces of the doors 2, 3, 4, and 5, a door shelf 6 for storing foods may be provided. On edges of the rear surfaces of the doors 2, 3, 4, and 5, a gasket 7 may be provided to be in close contact with a front surface of the main body 10 and seal the storage rooms 29 and 39.

Figure 3:
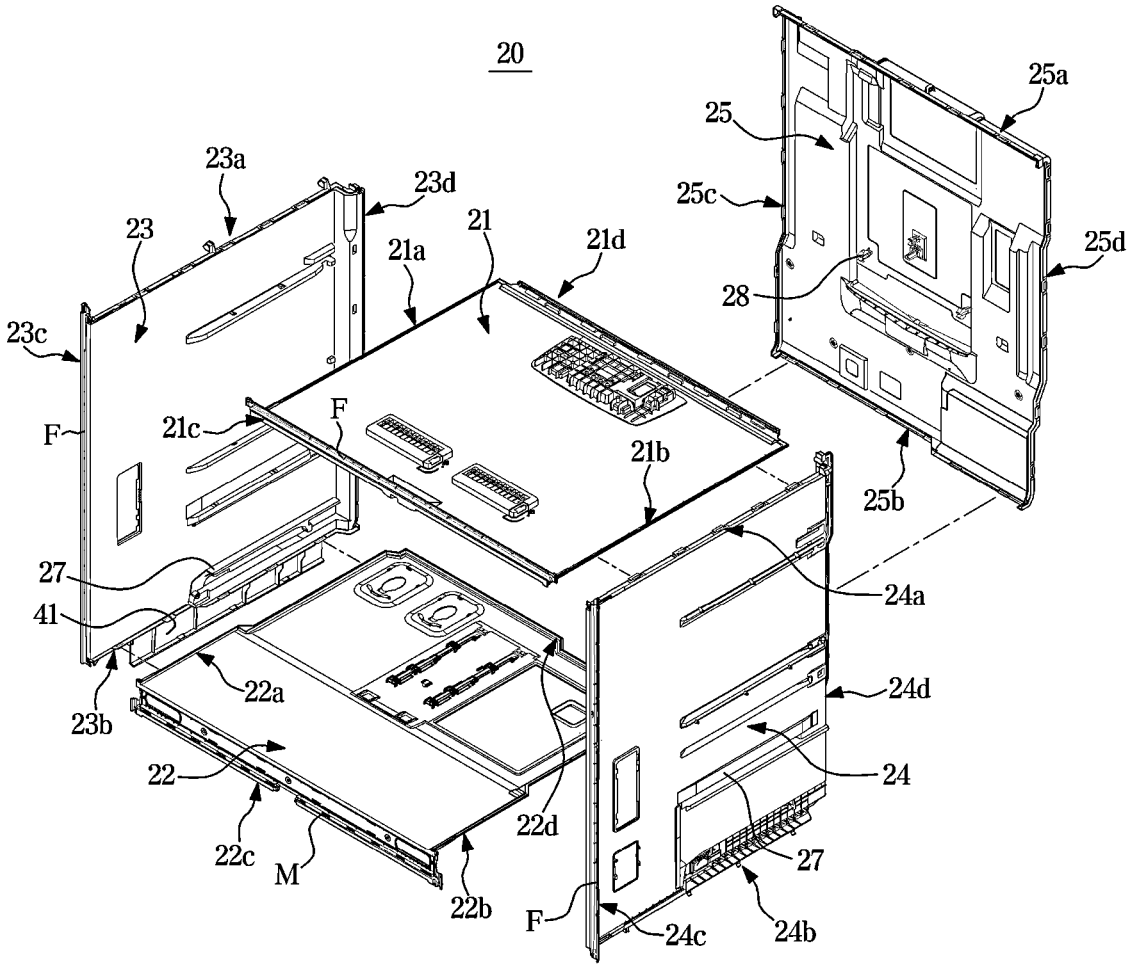
FIG. 3 is an exploded view of a first inner case according to an embodiment of the disclosure.

FIG. 3 is an exploded view of a first inner case according to an embodiment of the disclosure.

The first inner case 20 according to an embodiment of the disclosure will be described with reference to FIG. 3. Because the first inner case 20 and the second inner case 30 have no substantially great difference in structure, the following description about the first inner case 20 may be applied in the same way to the second inner case 30.

The first inner case 20 may include a plurality of plates 21, 22, 23, 24, and 25. The first inner case 20 may be formed by coupling the plurality of plates 21, 22, 23, 24, and 25 with each other. The plurality of plates 21, 22, 23, 24, and 25 may be coupled with each other without using a separate coupling member. That is, the plurality of plates 21, 22, 23, 24, and 25 may include coupling portions for mutual coupling, wherein the plurality of coupling portions are respectively integrated into the plates 21, 22, 23, 24, and 25.

The plurality of plates 21, 22, 23, 24, and 25 may be formed of a resin material by an injection molding method. Each of the plurality of plates 21, 22, 23, 24, and 25 may have four edges. The plurality of plates 21, 22, 23, 24, and 25 may include an upper plate 21, a lower plate 22, a left plate 23, a right plate 24, and a rear plate 25.

The upper plate 21 may form an upper surface of the storage room 29. The lower plate 22 may form a lower surface of the storage room 29. The left plate 23 may form a left surface of the storage room 29. The right plate 24 may form a right surface of the storage room 29. The rear plate 25 may form a rear surface of the storage room 29.

The upper plate 21, the lower plate 22, the left plate 23, the right plate 24, and the rear plate 25 are not limited to a flat shape without any curves, and the upper plate 21, the lower plate 22, the left plate 23, the right plate 24, and the rear plate 25 may include curves. The upper plate 21, the lower plate 22, the left plate 23, the right plate 24, and the rear plate 25 may have any shapes capable of forming the upper, lower, left, right, and rear surfaces of the storage room 29.

Also, unlike the current embodiment of the disclosure, at least two or more neighboring plates of the upper plate 21, the lower plate 22, the left plate 23, the right plate 24, and the rear plate 25 may be integrated into one body.

That is, unlike the current embodiment of the disclosure, the first inner case 20 may be configured with a smaller number of parts than five parts of the upper plate 21, the lower plate 22, the left plate 23, the right plate 24, and the rear plate 25.

For example, the upper plate 21 and the right plate 24 may be injection-molded into one body, and the lower plate 22 and the left plate 23 may be injection-molded into one body. Alternatively, the upper plate 21 and the left plate 23 may be injection-molded into one body, and the lower plate 22 and the right plate 24 may be injection-molded into one body.

As such, even in a case in which the first inner case 20 is configured with a smaller number of parts than five parts of the upper plate 21, the lower plate 22, the left plate 23, the right plate 24, and the rear plate 25, the following description will be applied in the same way.

A rail 27 slidably supporting the storage container 14 may be formed in each of the left plate 23 and the right plate 24. In the rear plate 25, a fixing portion 28 for fixing an evaporator may be formed.

The upper plate 21 may include a left edge 21*a*, a right edge 21*b*, a front edge 21*c*, and a rear edge 21*d*.

The lower plate 22 may include a left edge 22*a*, a right edge 22*b*, a front edge 22*c*, and a rear edge 22*d*.

The left plate 23 may include an upper edge 23*a*, a lower edge 23*b*, a front edge 23*c*, and a rear edge 23*d*.

The right plate 24 may include an upper edge 24*a*, a lower edge 24*b*, a front edge 24*c*, and a rear edge 24*d*.

The rear plate 25 may include an upper edge 25*a*, a lower edge 25*b*, a left edge 25*c*, and a right edge 25*d*.

The left edge 21*a* of the upper plate 21 may be coupled with the upper edge 23*a* of the left plate 23.

The right edge 21*b* of the upper plate 21 may be coupled with the upper edge 24*a* of the right plate 24.

The rear edge 21*d* of the upper plate 21 may be coupled with the upper edge 25*a* of the rear plate 25.

The left edge 22*a* of the lower plate 22 may be coupled with the lower edge 23*b* of the left plate 23.

The right edge 22*b* of the lower plate 22 may be coupled with the lower edge 24*b* of the right plate 24.

The rear edge 22*d* of the lower plate 22 may be coupled with the lower edge 25*b* of the rear plate 25.

The rear edge 23*d* of the left plate 23 may be coupled with the left edge 25*c* of the rear plate 25.

The rear edge 24*d* of the right plate 24 may be coupled with the right edge 25*d* of the rear plate 25.

As described above, the first inner case 20 may be formed by coupling the edges of the five plates 21, 22, 23, 24, and 25 with each other, and include eight coupling locations.

For coupling of the edges, coupling portions may be formed in the edges. In any ones of the plurality of edges to be coupled with each other, a plurality of first coupling portions 50, 250, 350, 450, 550, and 650 may be formed, and, in the other ones, a plurality of second coupling portions 70, 270, 370, 470, 570, and 670 may be formed (see FIGS. 7, 14, 18, 20, 21, and 23).

In the front edge 21*c* of the upper plate 21, the front edge 23*c* of the left plate 23, and the front edge 24*c* of the right plate 24, a front flange F forming the front surface of the first inner case 20 may be formed. In the front edge 22*c* of the lower plate 22, a middle connection plate M may be formed to be coupled with a front edge 31*c* (see FIG. 15) of an upper plate 31 of the second inner case 30.

An extension panel 41 may extend downward from the lower edge 23*b* of the left plate 23. The extension panel 41 may be coupled with a left plate 33 (see FIG. 15) of the second inner case 30. The extension panel 41 may prevent deformation of the inner cases 20 and 30 and the outer case 11, which is caused by a difference between a thickness of an insulation between the first inner case 20 and the outer case 11 and a thickness of an insulation between the second inner case 30 and the outer case 11.

Hereinafter, detailed structures of the first coupling portions and the second coupling portions will be described with reference to the drawings.

Figure 4:
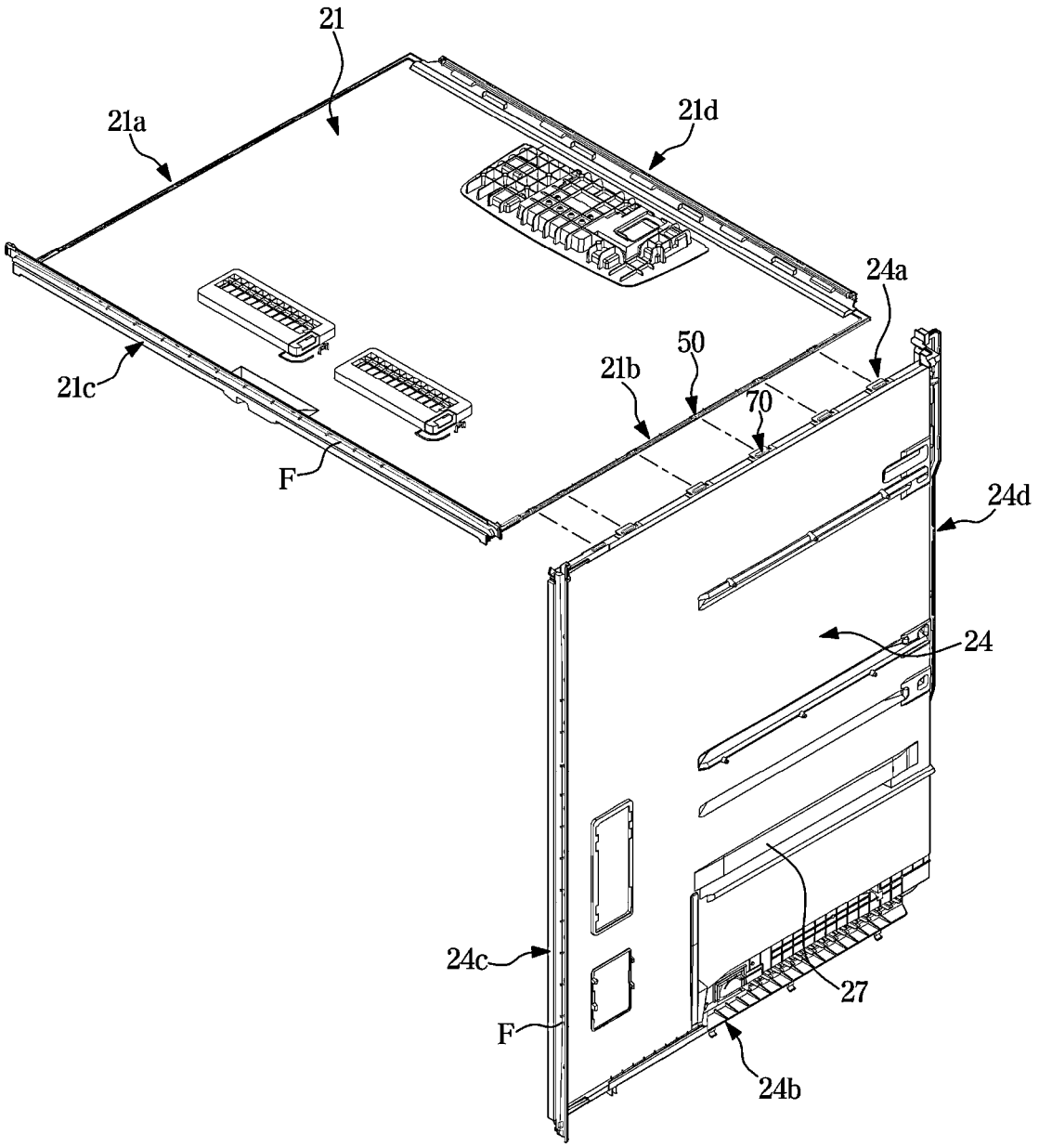
FIG. 4 shows an upper plate and a right plate according to an embodiment of the disclosure.
Figure 5:
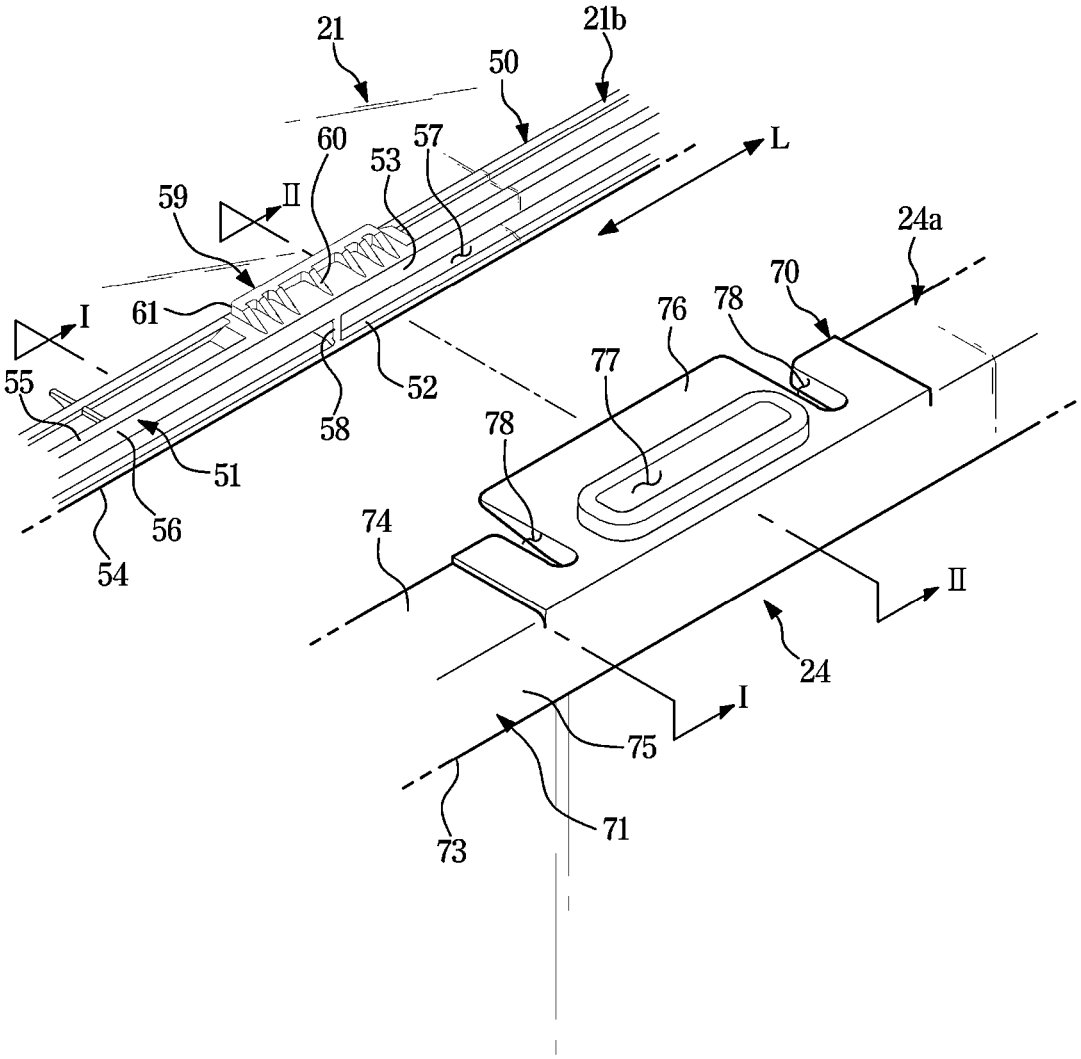
FIG. 5 shows a first coupling portion of an upper plate and a second coupling portion of a right plate, according to an embodiment of the disclosure.
Figure 6:
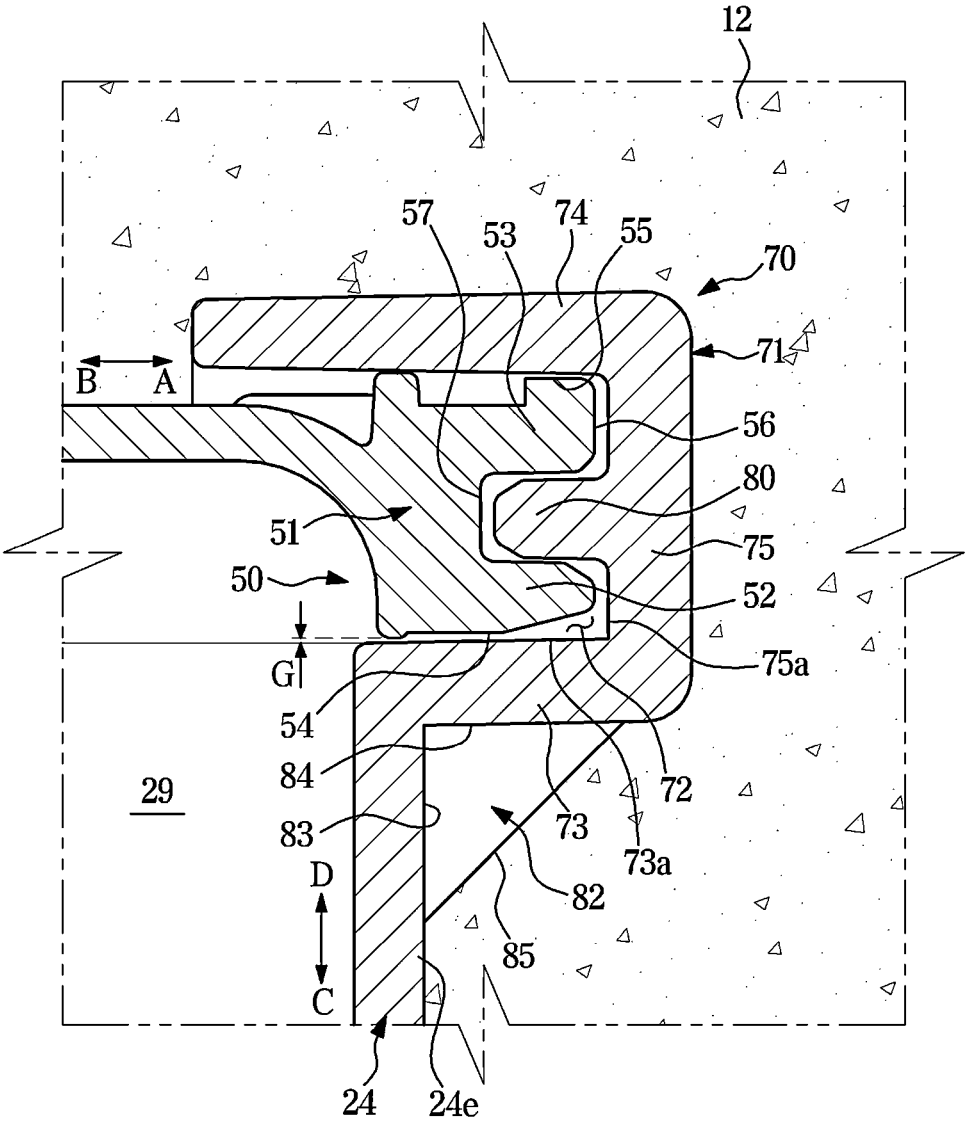
FIG. 6 is a cross-sectional view taken along line I-I of FIG. 5.
Figure 7:
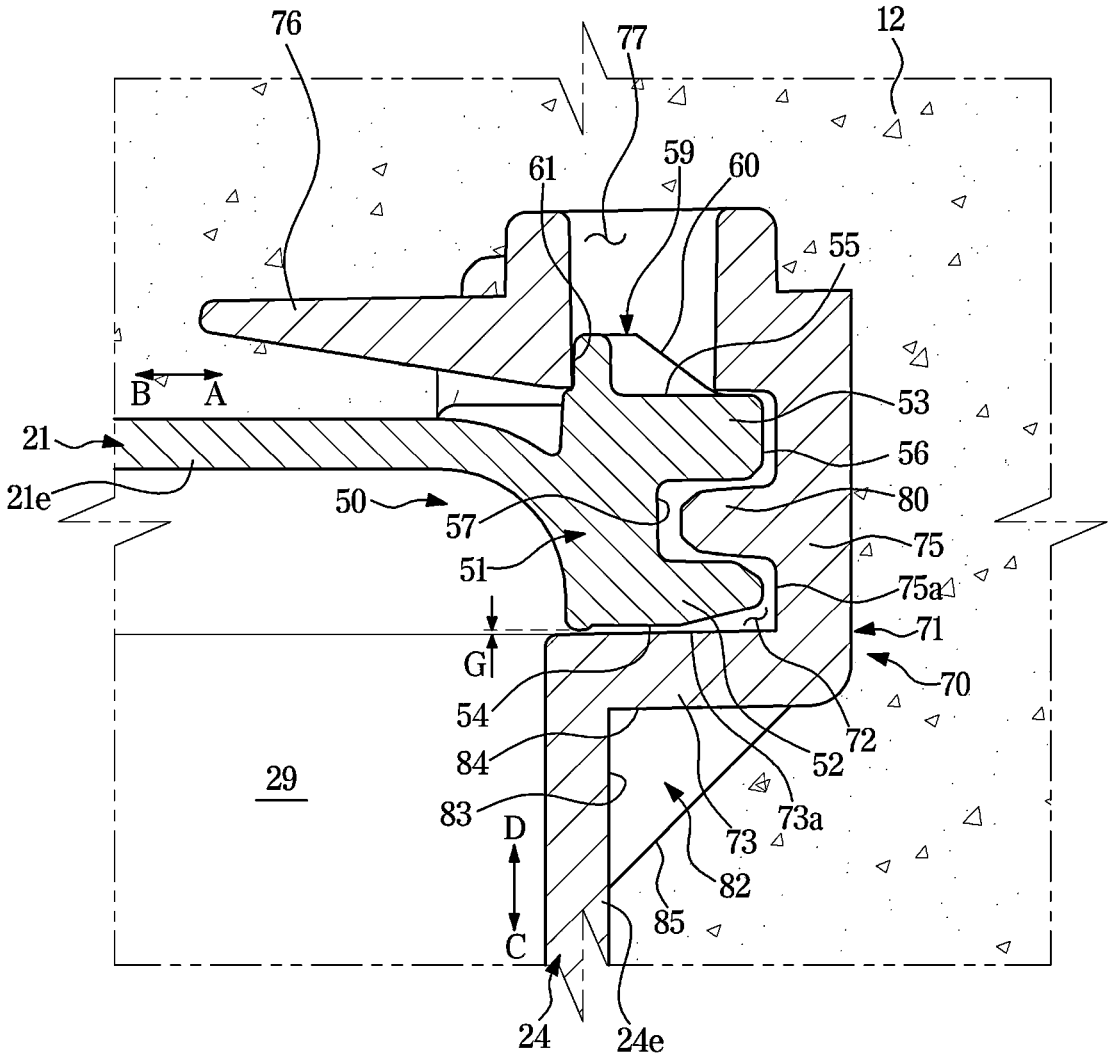
FIG. 7 is a cross-sectional view taken along line II-II of FIG. 5.
Figure 8:
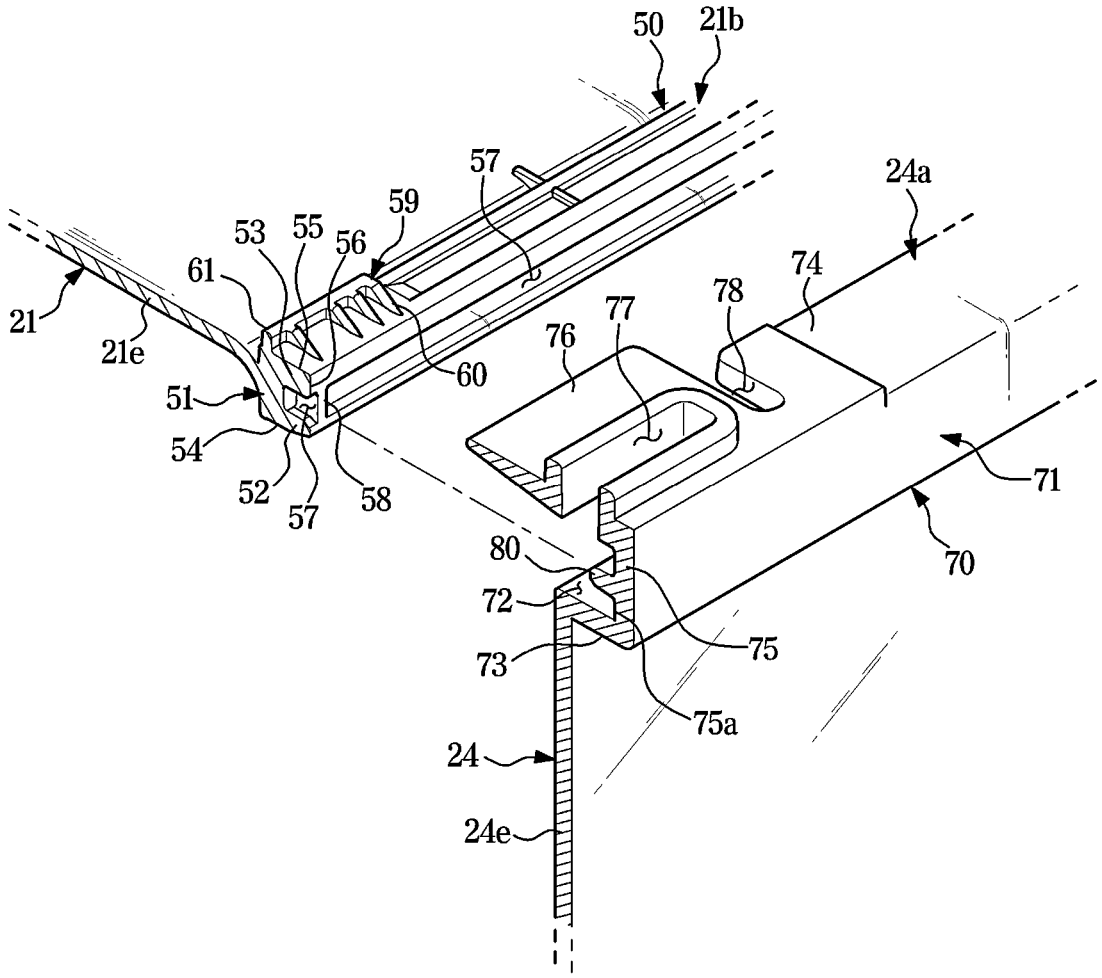
FIG. 8 is a cross-sectional view taken along line II-II of FIG. 5 and shown at another angle.
Figure 9:
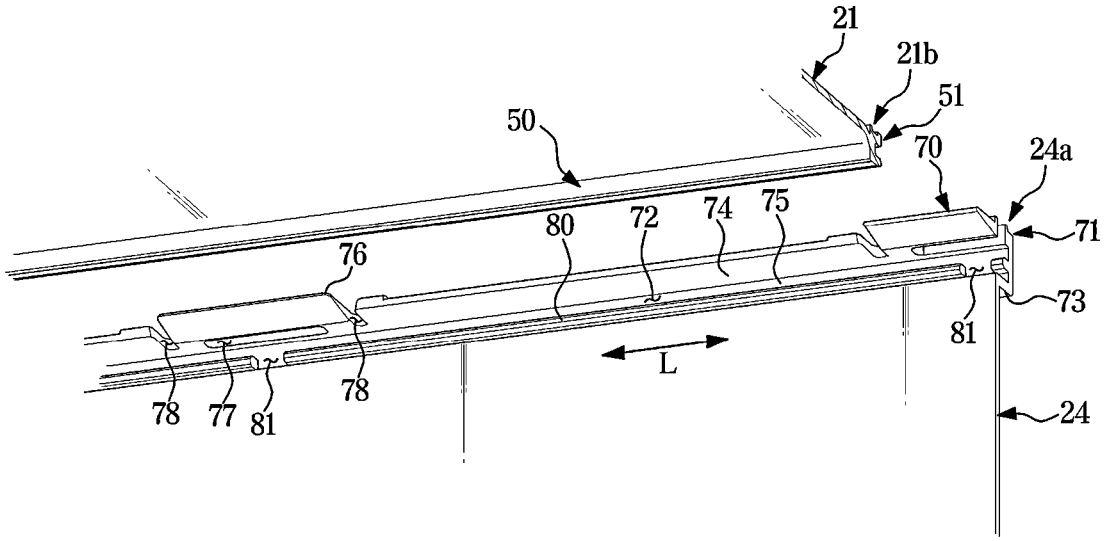
FIG. 9 is a cross-sectional view taken along line II-II of FIG. 5 and shown at another angle.
Figure 10:
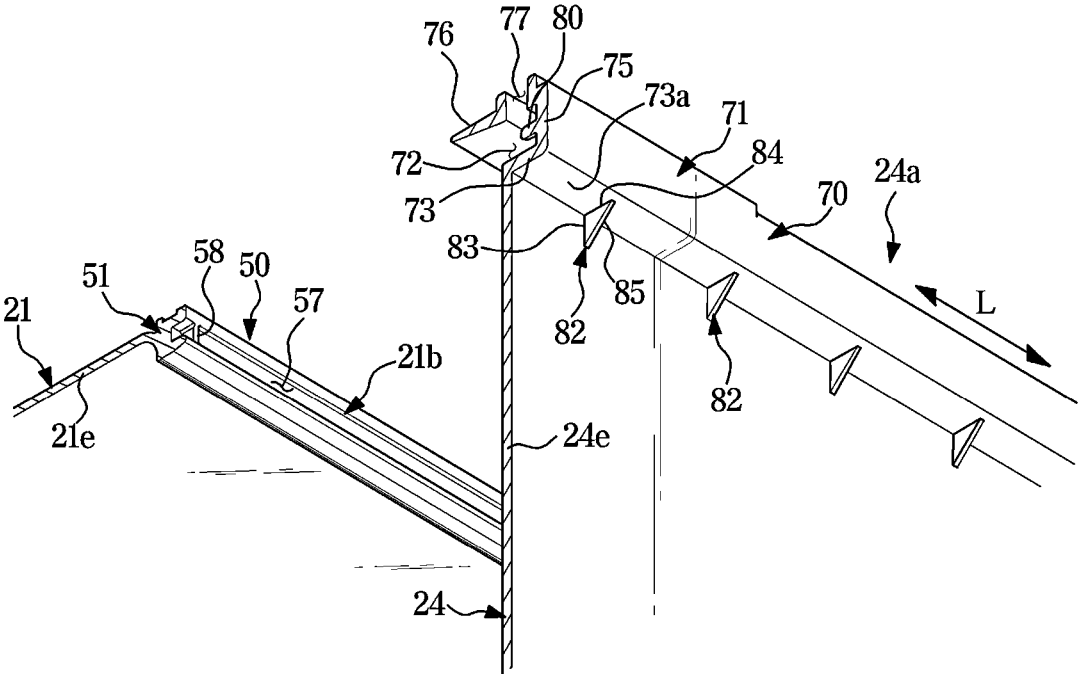
FIG. 10 is a cross-sectional view taken along line II-II of FIG. 5 and shown at another angle.

FIG. 4 shows an upper plate and a right plate according to an embodiment of the disclosure. FIG. 5 shows a first coupling portion of an upper plate and a second coupling portion of a right plate, according to an embodiment of the disclosure. FIG. 6 is a cross-sectional view taken along line I-I of FIG. 5. FIG. 7 is a cross-sectional view taken along line II-II of FIG. 5. FIG. 8 is a cross-sectional view taken along line II-II of FIG. 5 and shown at another angle. FIG. 9 is a cross-sectional view taken along line II-II of FIG. 5 and shown at another angle. FIG. 10 is a cross-sectional view taken along line II-II of FIG. 5 and shown at another angle.

A coupling structure of the right edge 21*b* of the upper plate 21 and the upper edge 24*a* of the right plate 24 will be described with reference to FIGS. 4 to 9.

After the upper plate 21 is coupled with the right plate 24, the upper plate 21 may be perpendicular to the right plate 24. After the upper plate 21 is coupled with the right plate 24, a longitudinal direction L of the right edge 21*b* of the upper plate 21 may be identical to a longitudinal direction L of the upper edge 24*a* of the right plate 24.

To couple the right edge 21*b* of the upper plate 21 with the upper edge 24*a* of the right plate 24, the first coupling portion 50 may be formed in the right edge 21*b* of the upper plate 21, and the second coupling portion 70 may be formed in the upper edge 24*a* of the right plate 24.

That is, the upper plate 21 may include an upper plate body 21*e*, and the first coupling portion 50 formed in the right edge 21*b*. The right plate 24 may include a right plate body 24*e*, and the second coupling portion 70 formed in the upper edge 24*a*.

However, contrary to the current embodiment of the disclosure, the second coupling portion 70 may be formed in the right edge 21*b* of the upper plate 21, and the first coupling portion 50 may be formed in the upper edge 24*a* of the right plate 24.

The first coupling portion 50 may be one of various embodiments of the first coupling portion. The second coupling portion 70 may be one of various embodiments of the second coupling portion. The structures of the first coupling portion 50 and the second coupling portion 70 may be applied in the same way to the edges of the other plates.

The first coupling portion 50 may include an insertion protrusion 51. The insertion protrusion 51 may protrude from the upper plate body 21*e* onto the same plane or on a plane being in parallel to the upper plate body 21*e*. The insertion protrusion 51 may extend along the longitudinal direction L of the edge 21*b*.

The second coupling portion 70 may include an accommodating portion 71 forming an accommodating groove 72 into which the insertion protrusion 51 is inserted. The accommodating groove 72 may extend along the longitudinal direction L of the upper edge 24*a* to correspond to the insertion protrusion 51.

The accommodating portion 71 may include a first wall 73, a second wall 74, and a third wall 75. The first wall 73, the second wall 74, and the third wall 75 may form the accommodating groove 72. The first wall 73 may be opposite to the second wall 74. The third wall 75 may connect the first wall 73 to the second wall 74.

The first wall 73 may protrude from the right plate body 24*e* toward the insulation 12. The first wall 73 may be formed perpendicular to the right plate body 24*e*.

The second coupling portion 70 may include a catching portion 77 for preventing the insertion protrusion 71 inserted in the accommodating groove 72 from departing from the accommodating groove 72. The insertion protrusion 51 may be inserted into the accommodating groove 72 in a first direction A, and the catching portion 77 may prevent the insertion protrusion 51 inserted in the accommodating groove 72 from departing from the accommodating groove 72 in a second direction B which is the opposite direction of the first direction A.

Also, the catching portion 77 may prevent the insertion protrusion 51 inserted in the accommodating groove 72 from moving in the longitudinal direction L of the upper edge 24*a*.

The second coupling portion 70 may include an elastic bracket 76 in which the catching portion 77 is formed. The elastic bracket 76 may be formed by being bent from the third wall 75. A portion of the second wall 74 may be cut, and the elastic bracket 76 may be positioned at the cut portion of the second wall 74. A slit 78 may be formed to both sides of the elastic bracket 76 to enable the elastic bracket 76 to be smoothly deformed elastically. The slit 78 may be formed to both sides of the elastic bracket 76 in the longitudinal direction L of the upper edge 24*a*.

The elastic bracket 76 may be, in a process of inserting the insertion protrusion 51 into the accommodating groove 72, pressed by a catching hook 59 and elastically deformed to be open. After the insertion protrusion 51 is inserted in the accommodating groove 72, the elastic bracket 76 may return to an original state.

The insertion protrusion 51 may include the catching hook 59 that is caught by the catching portion 77. The catching portion 77 may be formed in a shape of a hole by which the catching hook 59 is caught. However, unlike the current embodiment of the disclosure, the catching portion 77 may be formed in a shape of a groove. Also, the catching portion 77 may be formed in a shape of a hook or another shape corresponding to the catching hook.

The insertion protrusion 51 may include a first surface 54 corresponding to the first wall 73, a second surface 55 corresponding to the second wall 74, and a third surface 56 corresponding to the third wall 75. After the insertion protrusion 51 is inserted into the accommodating groove 72, the first surface 54 may face an inner surface of the first wall 73, the second surface 55 may face an inner surface of the second wall 74, and the third surface 56 may face an inner surface of the third wall 75.

The catching hook 59 may protrude from the second surface 55. The catching hook 59 may include an inclined surface 60 inclined to slide on the elastic bracket 76 while being in contact with the elastic bracket 76 upon inserting of the insertion protrusion 51 into the accommodating groove 72, and a catching surface 61 caught by the catching portion 77 after the insertion protrusion 51 is inserted in the accommodating groove 72.

The second coupling portion 70 may include an inner rib 80 protruding from the accommodating portion 71, wherein the inner rib 80 is inserted into the insertion protrusion 51 upon inserting of the insertion protrusion 51 into the accommodating groove 72. The inner rib 80 may protrude from the inner surface 75*a* of the third wall 75 toward the accommodating groove 72. The inner rib 80 may be spaced from the inner surface 73*a* of the first wall 73 and the inner surface of the second wall 74.

The inner rib 80 may protrude in the second direction B which is an insertion direction of the insertion protrusion 51 and is the opposite direction of the first direction A. Accordingly, in a process of inserting the insertion protrusion 51 into the accommodating groove 72, the inner rib 80 may also be naturally inserted into the insertion protrusion 51.

As such, by providing the inner rib 80 in the accommodating portion 71, the inner case 20 may be prevented from being deformed upon thermal contraction of the inner case 20 by low temperature of the storage room 29, and a gap G between the first coupling portion 50 and the second coupling portion 70 may be prevented from opening.

Upon thermal contraction of the right plate 24 by low temperature, the right plate 24 may be thermally contracted in a third direction C. The third direction C may be perpendicular to the first direction A and the second direction B.

In this case, the inner rib 80 may be supported by the insertion protrusion 51 in a fourth direction D which is opposite to the third direction C. Also, the inner rib 80 may press the insertion protrusion 51 in the third direction C. Accordingly, contractional deformation of the right plate 24 may be prevented, and accordingly, a space G between the first surface 54 of the insertion protrusion 51 and the inner surface 73*a* of the first wall 73 may be prevented from opening.

The insertion protrusion 51 may include a rib groove 57 in which the inner rib 80 is inserted. The rib groove 57 may be formed by being depressed in the third surface 56 of the insertion protrusion 51. The insertion protrusion 51 may include a first portion 52 formed between the rib groove 57 and the first surface 54, and a second portion 53 formed between the rib groove 57 and the second surface 55.

After the insertion protrusion 51 is inserted in the accommodating groove 72, the first portion 52 may be positioned between the first wall 73 and the inner rib 80, and the second portion 53 may be positioned between the second wall 74 and the inner rib 80.

As described above, the inner rib 80 may prevent thermal deformation of the inner case 20, while preventing a gap between the coupling portions from opening. Furthermore, the inner rib 80 may improve airtightness between the coupling portions.

The inner rib 80 may extend along the longitudinal direction L of the upper edge 24*a*. The rib groove 57 may extend along the longitudinal direction L of the right edge 21*b*.

The insertion protrusion 51 may include a guide pin 58 formed in the rib groove 57 and guiding the insertion protrusion 51 to be inserted into the accommodating groove 72. The guide pin 58 may guide the inner rib 80 to be inserted into the rib groove 57. The guide pin 58 may connect the first portion 52 to the second portion 53.

The inner rib 80 may include a guide groove 81 in which the guide pin 58 is inserted. After the guide pin 58 is inserted in the guide groove 81, the guide pin 58 may be supported by the inner rib 80 at both sides. Accordingly, the first coupling portion 50 and the second coupling portion 70 may be further prevented from moving in the longitudinal direction L of the upper edge 24*a* and the right edge 21*b*. A plurality of guide pins 58 may be provided, and the plurality of guide pins 58 may be spaced from each other along the longitudinal direction L of the right edge 21*b*.

The second coupling portion 70 may include an outer rib 82 provided on an outer side of the accommodating portion 71 and supporting the first wall 73. The outer rib 82 may connect an outer surface of the first wall 73 to the right plate body 24*e*. The outer rib 82 may be integrated into the right plate 24.

The outer rib 82 may be formed in a shape of a triangle. That is, the outer rib 82 may include a first contact surface 83 being in contact with an outer surface of the right plate body 24*e*, a second contact surface 84 being in contact with the outer surface of the first wall 73, and an inclined surface 85 connecting the first contact surface 83 to the second contact surface 84. A plurality of outer ribs 82 may be provided, and the plurality of outer ribs 82 may be spaced from each other along the longitudinal direction L of the upper edge 24*a*.

As such, by providing the outer rib 82, thermal deformation of the inner case 20 and gap opening between the coupling portions may be further prevented.

Figure 11:
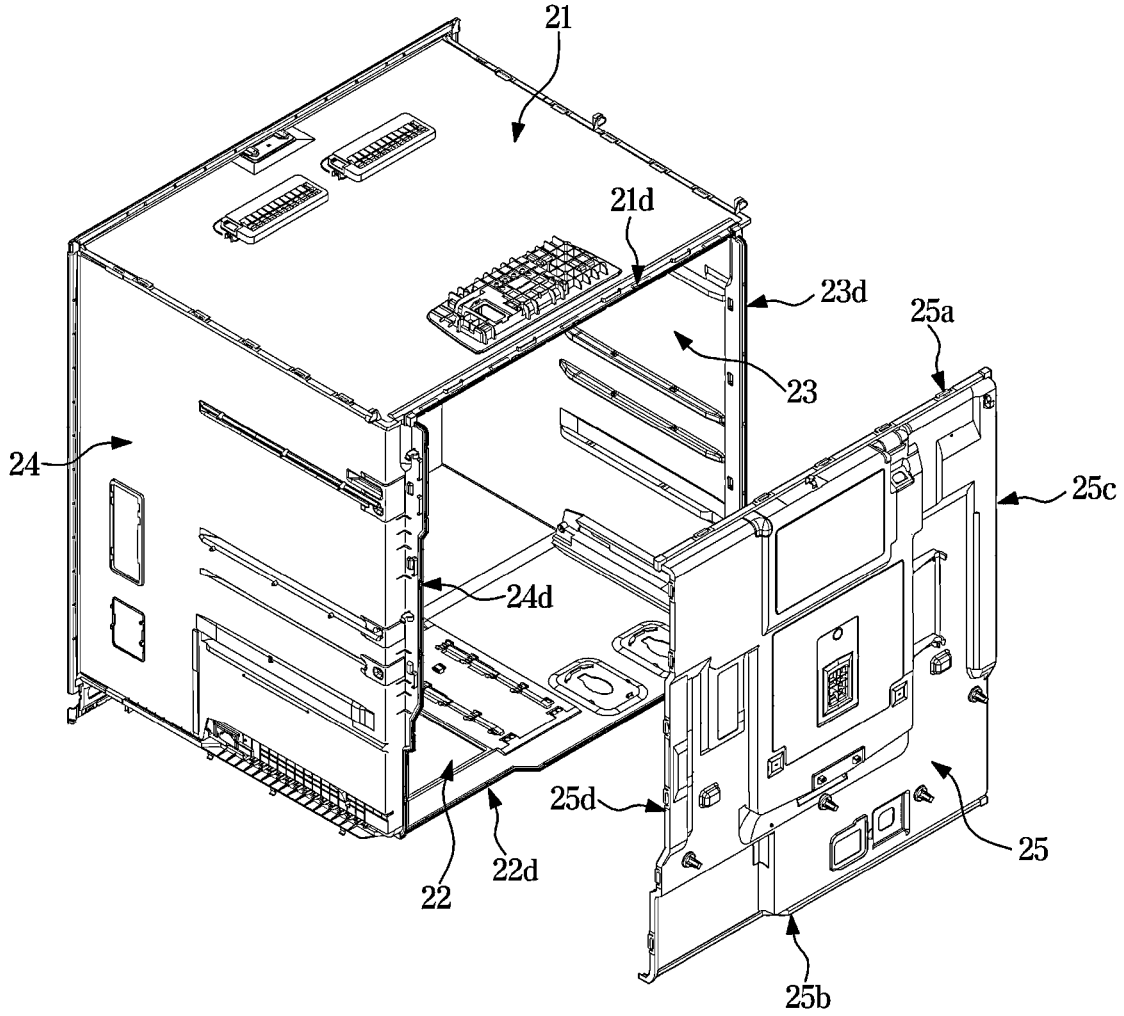
FIG. 11 shows a state in which an upper plate, a right plate, a left plate, and a lower plate, according to an embodiment of the disclosure, are coupled with each other, while a rear plate is separated from the other plates.
Figure 12:
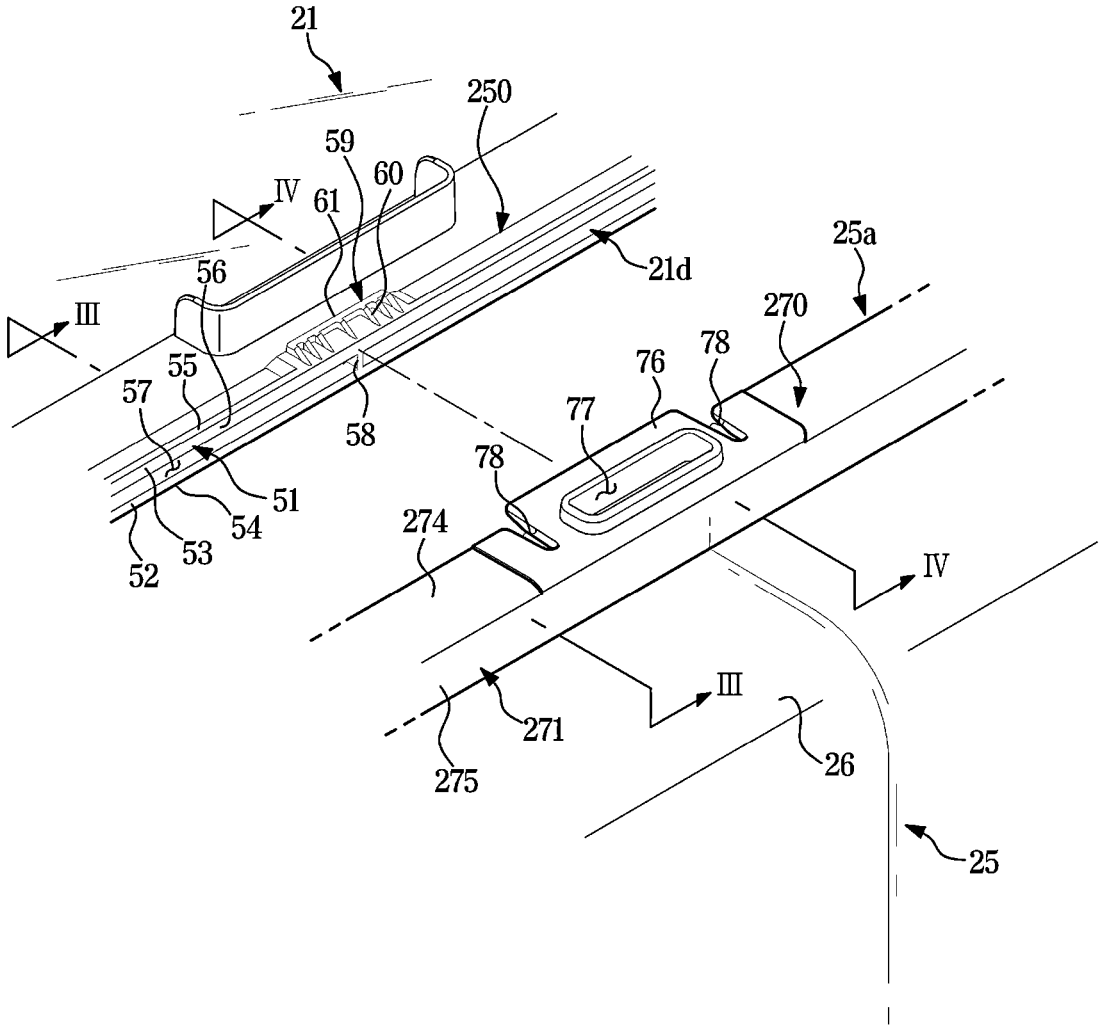
FIG. 12 shows an upper plate and a rear plate, according to an embodiment of the disclosure.
Figure 13:
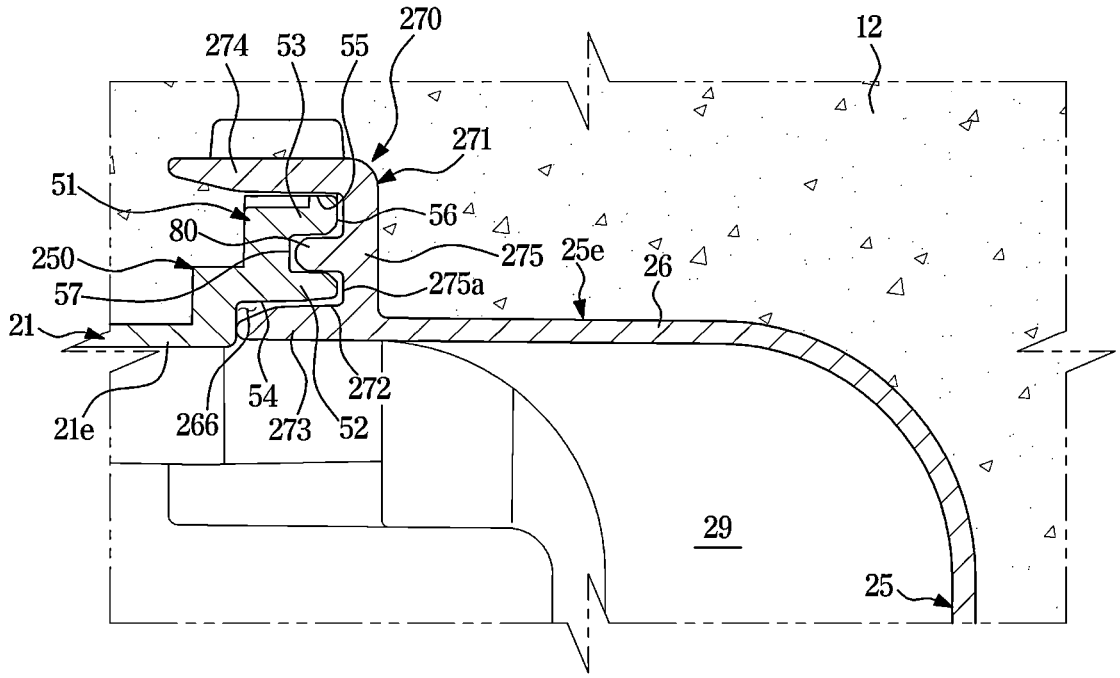
FIG. 13 is a cross-sectional view taken along line III-III of FIG. 12.
Figure 14:
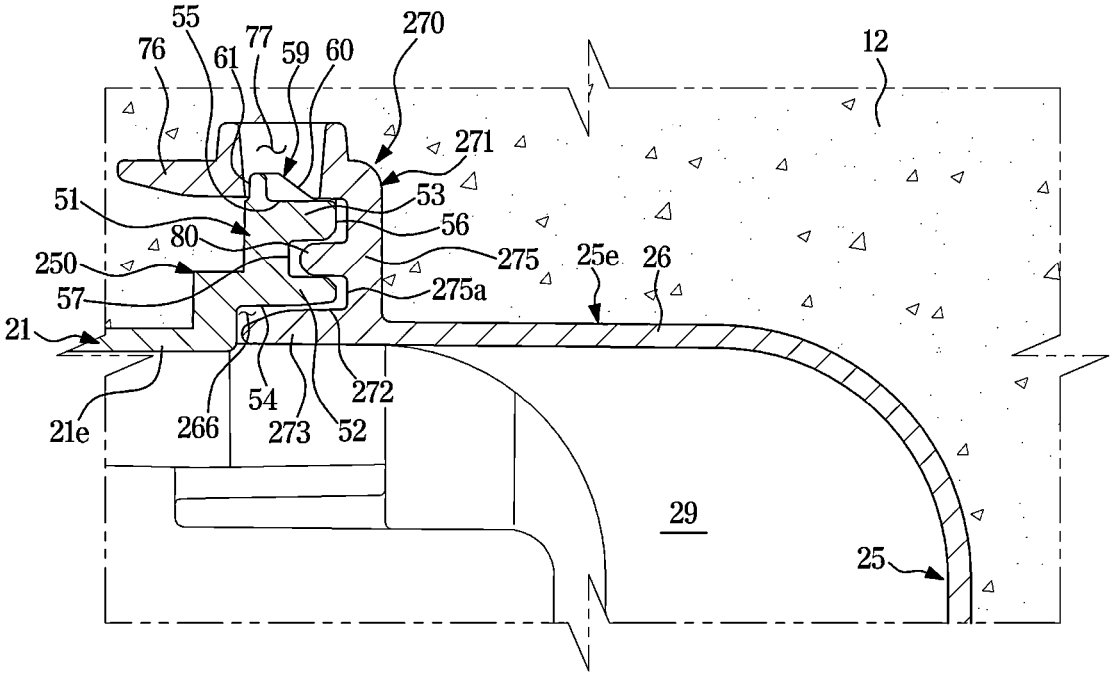
FIG. 14 is a cross-sectional view taken along line IV-IV of FIG. 12.

FIG. 11 shows a state in which an upper plate, a right plate, a left plate, and a lower plate, according to an embodiment of the disclosure, are coupled with each other, while a rear plate is separated from the other plates. FIG. 12 shows an upper plate and a rear plate, according to an embodiment of the disclosure. FIG. 13 is a cross-sectional view taken along line III-III of FIG. 12.

A coupling structure of the rear edge 21*d* of the upper plate 21 and the upper edge 25*a* of the rear plate 25 will be described with reference to FIGS. 11 to 14.

To couple the rear edge 21*d* of the upper plate 21 with the upper edge 25*a* of the rear plate 25, a first coupling portion 250 may be formed in the rear edge 21*d* of the upper plate 21, and a second coupling portion 270 may be formed in the upper edge 25*a* of the rear plat e 25.

That is, the upper plate 21 may include the upper plate body 21*e*, and the first coupling portion 250 formed in the rear edge 21*d*. The rear plate 25 may include the rear plate body 25*e*, and the second coupling portion 270 formed in the upper edge 25*a*.

However, contrary to the current embodiment of the disclosure, the second coupling portion 270 may be formed in the rear edge 21*d* of the upper plate 21, and the first coupling portion 250 may be formed in the upper edge 25*a* of the rear plate 25.

The first coupling portion 250 may be one of various embodiments of the first coupling portion. The second coupling portion 270 may be one of various embodiments of the second coupling portion. Structures of the first coupling portion 250 and the second coupling portion 270 may be applied in the same way to the edges of the other plates.

The structures of the first coupling portion 250 and the second coupling portion 270 may be the substantially same as those of the first coupling portion 50 and the second coupling portion 70 as described above, except for some differences. Therefore, in the following description, the same components as those of the first coupling portion 50 and the second coupling portion 70 will be assigned like reference numerals, and descriptions about the same components will be omitted.

The first coupling portion 250 may include the insertion protrusion 51. The insertion protrusion 51 may protrude from the upper plate body 21*e* onto a plane being in parallel to the upper plate body 21*e*. The insertion protrusion 51 may extend along the longitudinal direction L of the rear edge 21*d*.

An accommodating space 266 may be formed between the insertion protrusion 51 and the upper plate body 21*e*. A first wall 273 of the second coupling portion 270 may be accommodated in the accommodating space 266. Because the first wall 273 is accommodated in the accommodating space 266, the first wall 273 may be prevented from further protruding toward the storage room 29 than the upper plate body 21*e*.

The second coupling portion 270 may include an accommodating portion 271 forming an accommodating groove 272 in which the insertion protrusion 51 is inserted. The accommodating groove 272 may extend along the longitudinal direction L of the upper edge 25*a* to correspond to the insertion protrusion 51.

The accommodating portion 271 may include the first wall 273, a second wall 274, and a third wall 275. The first wall 273, the second wall 274, and the third wall 275 may form the accommodating groove 272. The first wall 273 may be opposite to the second wall 274. The third wall 275 may connect the first wall 273 to the second wall 274.

The first wall 273 may extend from the rear plate body 25*e* onto the same plane as the rear plate body 25*e*. That is, unlike the above-described first wall 73 protruding toward the insulation 12 from the right plate body 24*e*, the first wall 273 may be formed by the rear plate body 25*e* extending onto the same plane without being bent toward the insulation 12.

The third wall 275 may protrude from the rear plate body 25*e* toward the insulation 12 and connect the first wall 273 to the second wall 274.

Because the first wall 273 extends from the rear plate body 25*e* onto the same plane as the rear plate body 25*e* as described above, the rear plate 25 may include a bending portion 26 bent toward the upper plate 21.

The second coupling portion 270 may include a catching portion 77 for preventing the insertion protrusion 51 inserted in the accommodating groove 272 from departing from the accommodating groove 272.

The second coupling portion 270 may include an elastic bracket 76 in which the catching portion 77 is formed. The elastic bracket 76 may be formed by being bent from the third wall 275. A portion of the second wall 274 may be cut, and the elastic bracket 76 may be positioned in the cut portion of the second wall 274.

The elastic bracket 76 may be, in a process of inserting the insertion protrusion 51 into the accommodating groove 272, pressed by the catching hook 59 and elastically deformed to be open. After the insertion protrusion 51 is inserted in the accommodating groove 272, the elastic bracket 76 may return to an original state.

The insertion protrusion 51 may include a first surface 54 corresponding to the first wall 273, a second surface 55 corresponding to the second wall 274, and a third surface 56 corresponding to the third wall 275. After the insertion protrusion 51 is inserted in the accommodating groove 272, the first surface 54 may face an inner surface of the first wall 273, the second surface 55 may face an inner surface of the second wall 274, and the third surface 56 may face an inner surface 275*a* of the third wall 275.

The catching hook 59 may protrude from the second surface 55. The catching hook 59 may include an inclined surface 60 inclined to slide on the elastic bracket 76 while being in contact with the elastic bracket 76 upon inserting of the insertion protrusion 51 into the accommodating groove 272, and a catching surface 61 caught by the catching portion 77 after the insertion protrusion 51 is inserted in the accommodating groove 72.

The second coupling portion 270 may include an inner rib 80 protruding from the accommodating portion 271, wherein the inner rib 80 is inserted into the insertion protrusion 51 upon inserting of the insertion protrusion 51 into the accommodating groove 272. The inner rib 80 may protrude from the inner surface 275*a* of the third wall 275 toward the accommodating groove 272. The inner rib 80 may be spaced from the inner surface of the first wall 273 and the inner surface of the second wall 274.

The insertion protrusion 51 may include a rib groove 57 in which the inner rib 80 is inserted. The rib groove 57 may be formed by being depressed in the third surface 56 of the insertion protrusion 51.

Figure 15:
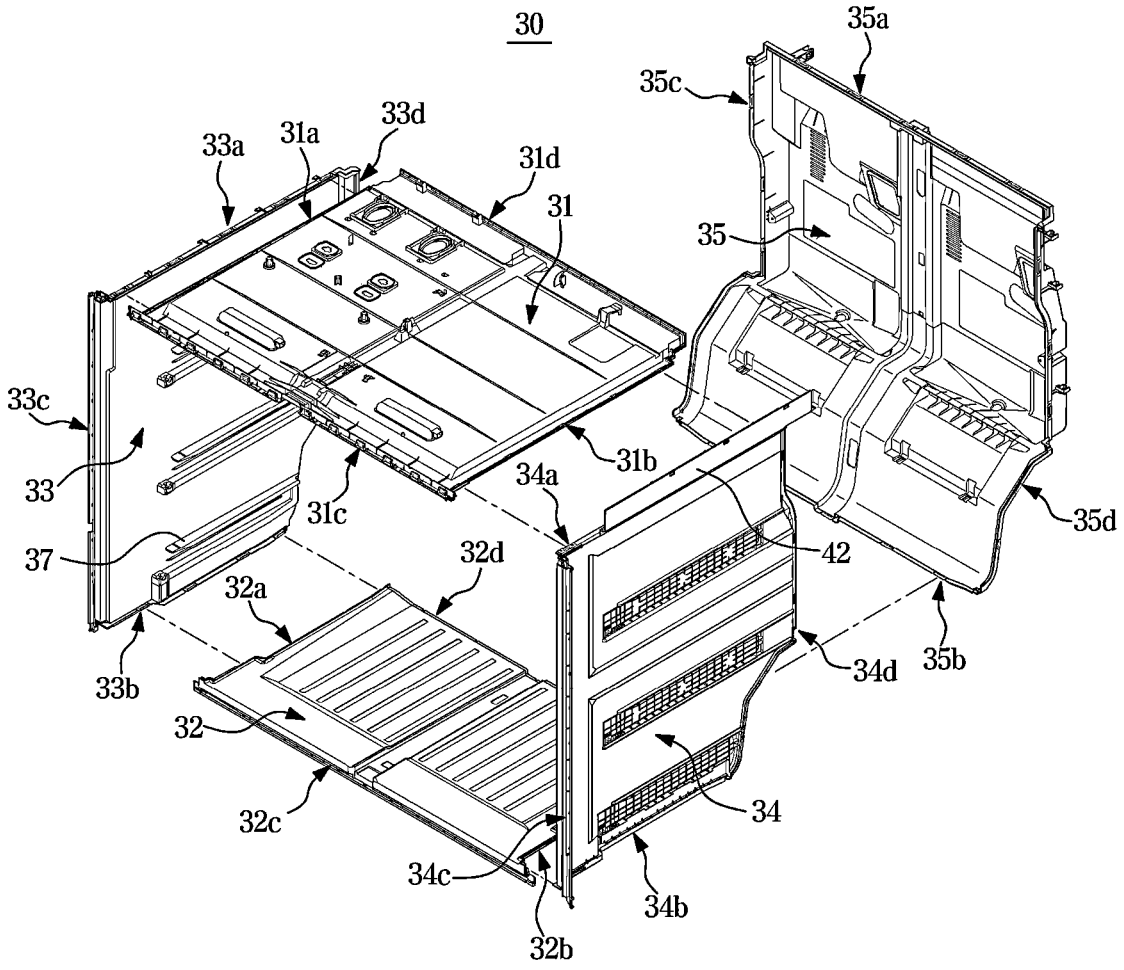
FIG. 15 is an exploded view of a second inner case according to an embodiment of the disclosure.
Figure 16:
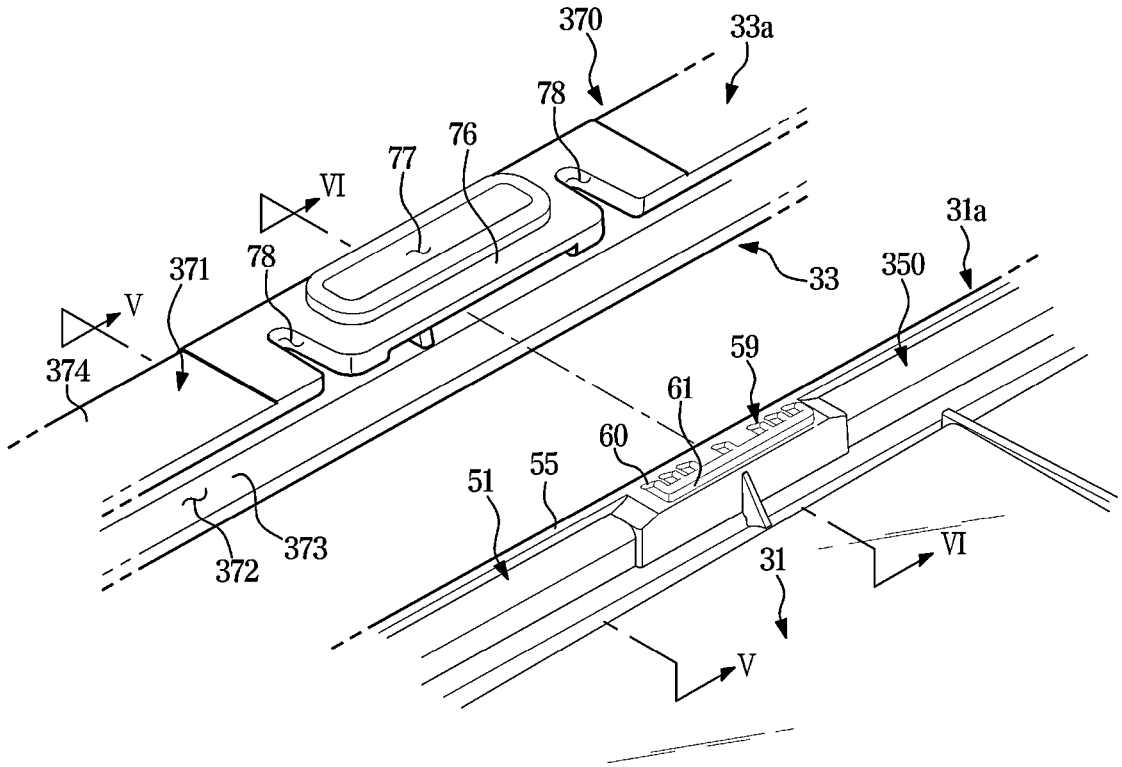
FIG. 16 shows an upper plate and a left plate, according to an embodiment of the disclosure.
Figure 17:
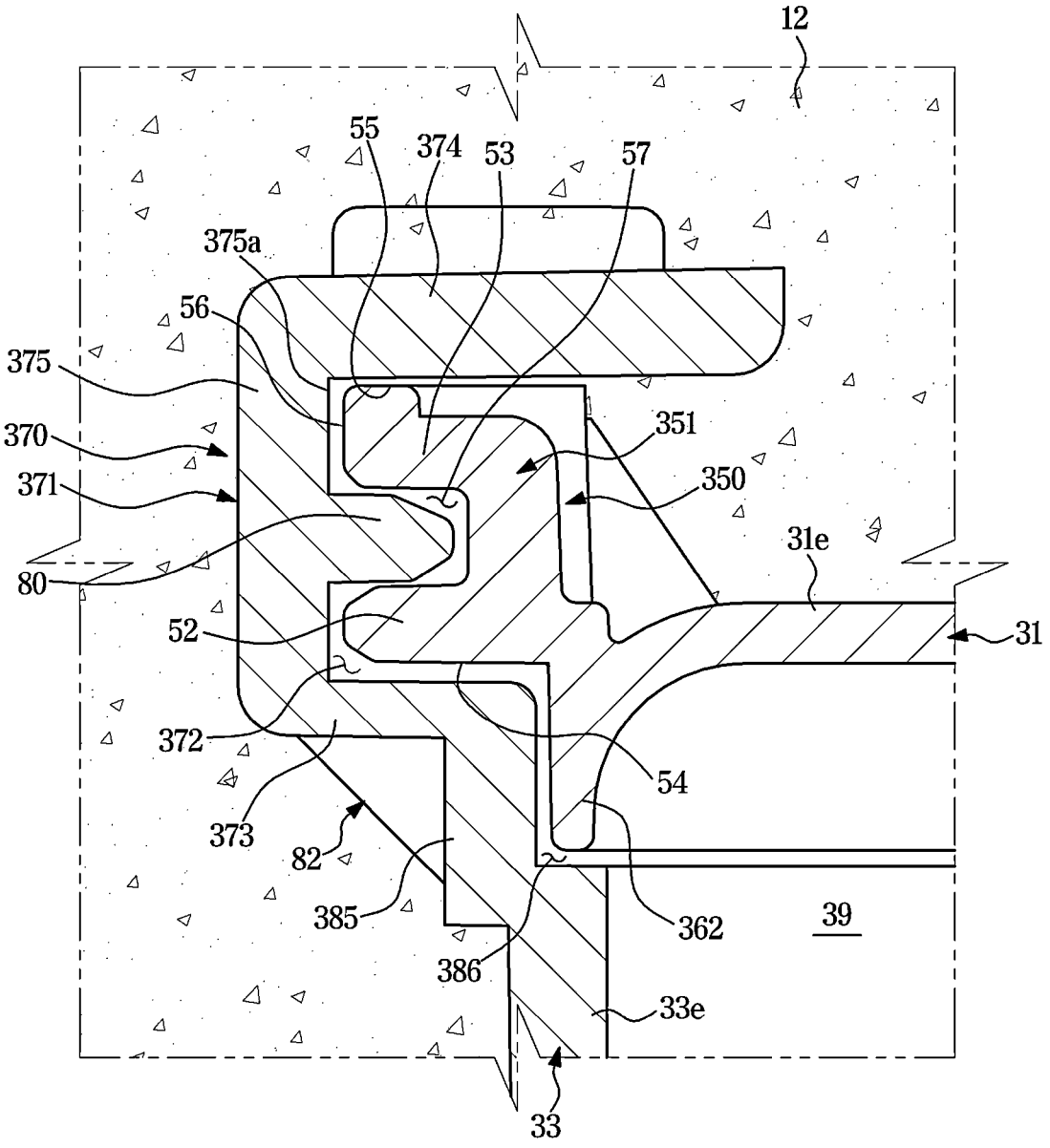
FIG. 17 is a cross-sectional view taken along line V-V of FIG. 16.
Figure 18:
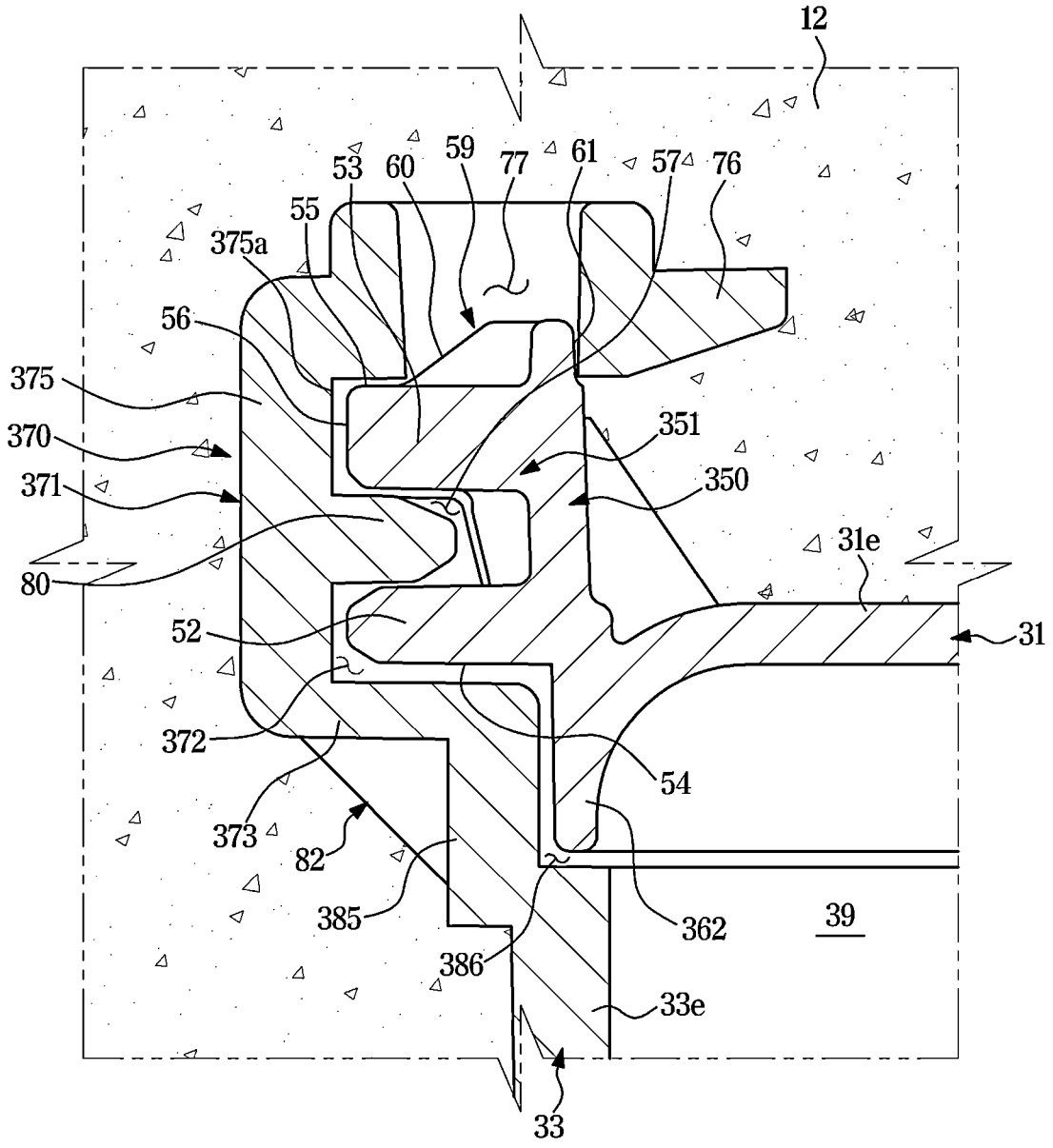
FIG. 18 is a cross-sectional view taken along line VI-VI of FIG. 16.

FIG. 15 is an exploded view of a second inner case according to an embodiment of the disclosure. FIG. 16 shows an upper plate and a left plate, according to an embodiment of the disclosure. FIG. 17 is a cross-sectional view taken along line V-V of FIG. 16. FIG. 18 is a cross-sectional view taken along line VI-VI of FIG. 16.

A structure of the second inner case 30 and a coupling structure of a left edge 31*a* of the upper plate 31 of the second inner case 30 and an upper edge 33*a* of the left plate 33 of the second inner case 30 will be described with reference to FIGS. 15 to 18.

The second inner case 30 may include a plurality of plates 31, 32, 33, 34, and 35. The second inner case 30 may be formed by coupling the plurality of plates 31, 32, 33, 34, and 35 with each other. The plurality of plates 31, 32, 33, 34, and 35 may be coupled with each other without using a separate coupling member. That is, the plurality of plates 31, 32, 33, 34, and 35 may include coupling portions for mutual coupling, wherein the plurality of coupling portions are respectively integrated into the plates 31, 32, 33, 34, and 35.

The plurality of plates 31, 32, 33, 34, and 35 may be formed of a resin material by an injection molding method. Each of the plurality of plates 31, 32, 33, 34, and 35 may have four edges. The plurality of plates 31, 32, 33, 34, and 35 may include an upper plate 31, a lower plate 32, a left plate 33, a right plate 34, and a rear plate 35.

The upper plate 31 may include the left edge 31*a*, a right edge 31*b*, a front edge 31*c*, and a rear edge 31*d*.

The lower plate 32 may include a left edge 32*a*, a right edge 32*b*, a front edge 32*c*, and a rear edge 32*d*.

The left plate 33 may include the upper edge 33*a*, a lower edge 33*b*, a front edge 33*c*, and a rear edge 33*d*.

The right plate 34 may include an upper edge 34*a*, a lower edge 34*b*, a front edge 34*c*, and a rear edge 34*d*.

The right plate 35 may include an upper edge 35*a*, a lower edge 35*b*, a left edge 35*c*, and a right edge 35*d*.

The left edge 31*a* of the upper plate 31 may be coupled with the upper edge 33*a* of the left plate 33.

The right edge 31*b* of the upper plate 31 may be coupled with the upper edge 34*a* of the right plate 34.

The rear edge 31*d* of the upper plate 31 may be coupled with the upper edge 35*a* of the rear plate 35.

The left edge 32*a* of the lower plate 32 may be coupled with the lower edge 33*b* of the left plate 33.

The right edge 32*b* of the lower plate 32 may be coupled with the lower edge 34*b* of the right plate 34.

The rear edge 32*d* of the lower plate 32 may be coupled with the lower edge 35*b* of the rear plate 34.

The rear edge 33*d* of the left plate 33 may be coupled with the left edge 35*c* of the rear plate 35.

The left edge 34*d* of the right plate 34 may be coupled with the right edge 35*d* of the rear plate 35.

As described above, the second inner case 30 may be formed by coupling the edges of the five plates 31, 32, 33, 34, and 35 with each other, and include eight coupling locations.

For coupling of the edges, the coupling portions may be formed in the edges. In any ones of the plurality of edges to be coupled with each other, a plurality of first coupling portions 50, 250, and 350 may be formed, and, in the other ones, a plurality of second coupling portions 70, 270 and 370 may be formed (see FIGS. 7, 14, and 18).

In the front edge 32*c* of the lower plate 32, the front edge 33*c* of the left plate 33, and the front edge 34*c* of the right plate 34, a front flange forming the front surface of the second inner case 30 may be formed. An extension panel 42 may extend upward from the upper edge 34*a* of the right plate 34. The extension panel 42 may be coupled with the right plate 24 of the first inner case 20.

To couple the left edge 31*a* of the upper plate 31 with the upper edge 33*a* of the left plate 33, the first coupling portion 350 may be formed in the left edge 31*a* of the upper plate 31, and the second coupling portion 370 may be formed in the upper edge 33*a* of the left plate 33.

That is, the upper plate 31 may include an upper plate body 31*e*, and the first coupling portion 350 formed in the left edge 31*a*. The left plate 33 may include a left plate body 33*e*, and the second coupling portion 370 formed in the upper edge 33*a*.

However, contrary to the current embodiment of the disclosure, the second coupling portion 370 may be formed in the left edge 31*a* of the upper plate 31, and the first coupling portion 350 may be formed in the upper edge 33*a* of the left plate 33.

The first coupling portion 350 may be one of various embodiments of the first coupling portion. The second coupling portion 370 may be one of various embodiments of the second coupling portion. The structures of the first coupling portion 350 and the second coupling portion 370 may be applied in the same way to the edges of the other plates.

The structures of the first coupling portion 350 and the second coupling portion 370 may be the substantially same as those of the first coupling portions 50 and 250 and the second coupling portions 70 and 270 as described above, except for some differences. Therefore, in the following description, the same components as those of the first coupling portions 50 and 250 and the second coupling portions 70 and 270 are assigned like reference numerals, and descriptions about the same components will be omitted.

The first coupling portion 350 may include an insertion protrusion 351. The insertion protrusion 351 may protrude from the upper plate body 31*e* onto the same plane as the upper plate body 31*e* or onto a plane being in parallel to the upper plate body 31*e*. The insertion protrusion 351 may extend along the longitudinal direction of the left edge 31*a*.

Unlike the above-described embodiments of the disclosure, the first coupling portion 350 may further include an auxiliary protrusion 362 formed at the opposite side of the insertion protrusion 351.

The second coupling portion 370 may include a step portion 385 stepped toward the insulation 12 and being in contact with the auxiliary protrusion 362. An accommodating space 386 may be formed between the step portion 385 and the left plate body 33*e*. The auxiliary protrusion 362 of the first coupling portion 370 may be accommodated in the accommodating space 386. Because the auxiliary protrusion 362 is accommodated in the accommodating space 386, the auxiliary protrusion 362 may be prevented from further protruding toward the storage room 39 than the left plate body 33*e*.

Due to the auxiliary protrusion 362 and the step portion 385, thermal deformation of the inner case 30 may be further reduced and airtightness between the first coupling portion 350 and the second coupling portion 370 may be further improved.

The second coupling portion 370 may include an accommodating portion 371 forming an accommodating groove 372 in which the insertion protrusion 351 is inserted. The accommodating groove 372 may extend along the longitudinal direction of the upper edge 33*a* to correspond to the insertion protrusion 351.

The accommodating portion 371 may include a first wall 373, a second wall 374, and a third wall 375. The first wall 373, the second wall 374, and the third wall 375 may form the accommodating groove 372. The first wall 373 may be opposite to the second wall 374. The third wall 375 may connect the first wall 373 to the second wall 374.

The first wall 373 may protrude from the step portion 385 toward the insulation 12. The first wall 373 may be perpendicular to the left plate body 33*e*.

The second coupling portion 370 may include a catching portion 77 for preventing the insertion protrusion 351 inserted in the accommodating groove 372 from departing from the accommodating groove 372.

The second coupling portion 370 may include an elastic bracket 76 in which the catching portion 77 is formed. The elastic bracket 76 may be formed by being bent from the third wall 375. A portion of the second wall 374 may be cut, and the elastic bracket 76 may be positioned at the cut portion of the second wall 374.

The elastic bracket 76 may be, in a process of inserting the insertion protrusion 351 into the accommodating groove 372, pressed by the catching hook 59 and elastically deformed to be open. After the insertion protrusion 51 is inserted in the accommodating groove 372, the elastic bracket 76 may return to an original state.

The insertion protrusion 351 may include a first surface 54 corresponding to the first wall 373, a second surface 55 corresponding to the second wall 374, and a third surface 56 corresponding to the third wall 375. After the insertion protrusion 351 is inserted in the accommodating groove 372, the first surface 54 may face an inner surface of the first wall 373, the second surface 55 may face an inner surface of the second wall 374, and the third surface 56 may face an inner surface 375*a* of the third wall 375.

The catching hook 59 may protrude from the second surface 55. The catching hook 59 may include an inclined surface 60 inclined to slide on the elastic bracket 76 while being in contact with the elastic bracket 76 upon inserting of the insertion protrusion 351 into the accommodating groove 372, and a catching surface 61 caught by the catching portion 77 after the insertion protrusion 51 is inserted in the accommodating groove 372.

The second coupling portion 370 may include an inner rib 80 protruding from the accommodating portion 371, wherein the inner rib 80 is inserted into the insertion protrusion 351 upon inserting of the insertion protrusion 351 into the accommodating groove 372. The inner rib 80 may protrude from the inner surface 375*a* of the third wall 375 toward the accommodating groove 372. The inner rib 80 may be spaced from the inner surface of the first wall 373 and the inner surface of the second wall 374.

The insertion protrusion 351 may include a rib groove 57 in which the inner rib 80 is inserted. The rib groove 57 may be formed by being depressed in the third surface 56 of the insertion protrusion 351.

The second coupling portion 370 may include an outer rib 382 provided on an outer side of the accommodating portion 371 and supporting the first wall 373. The outer rib 382 may connect an outer surface of the first wall 373 to the step portion 385. The outer rib 382 may be integrated into the left plate 33.

Figure 19:
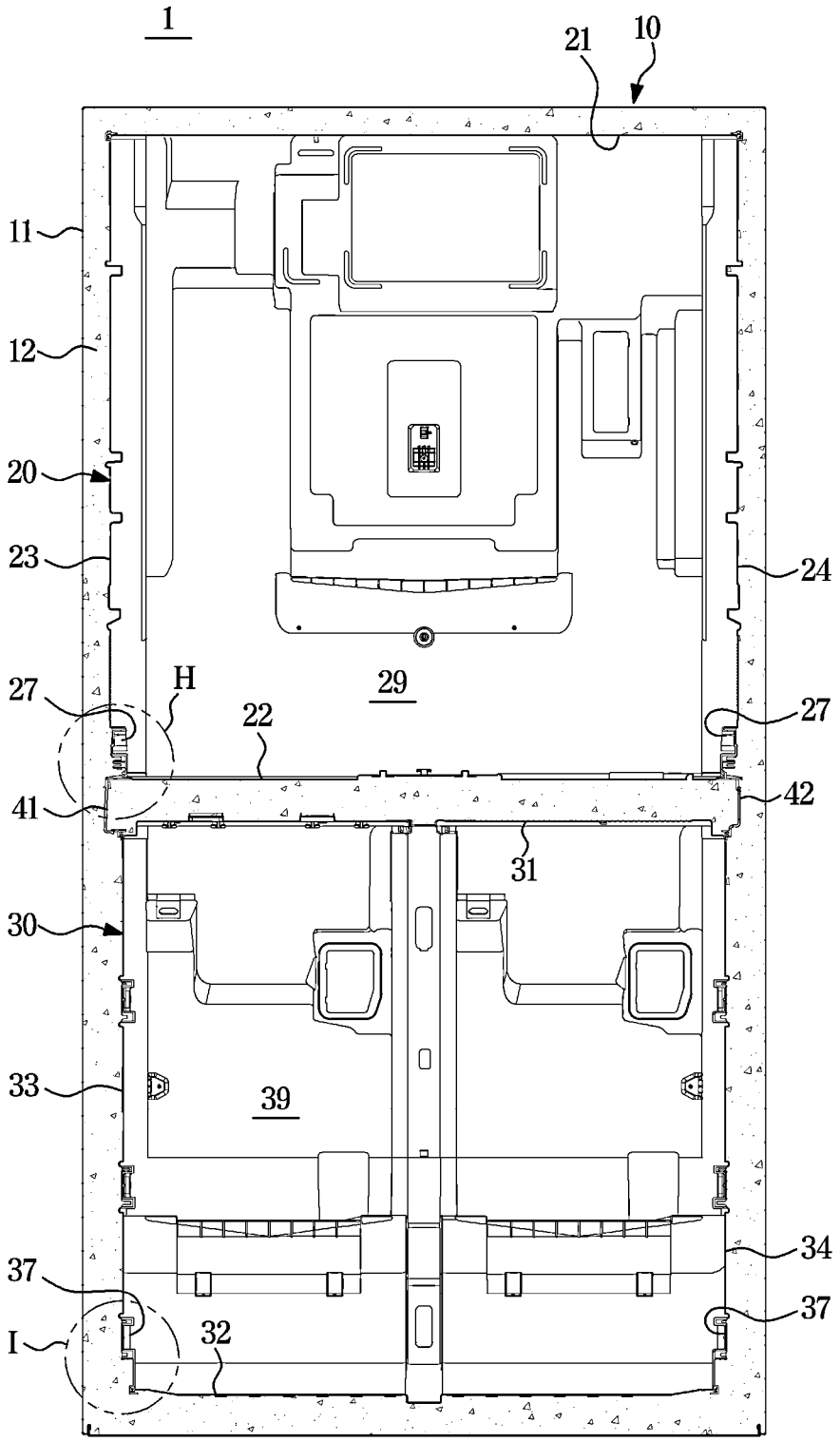
FIG. 19 is a front cross-sectional view showing an inner case and an outer case of a refrigerator according to an embodiment of the disclosure.
Figure 20:
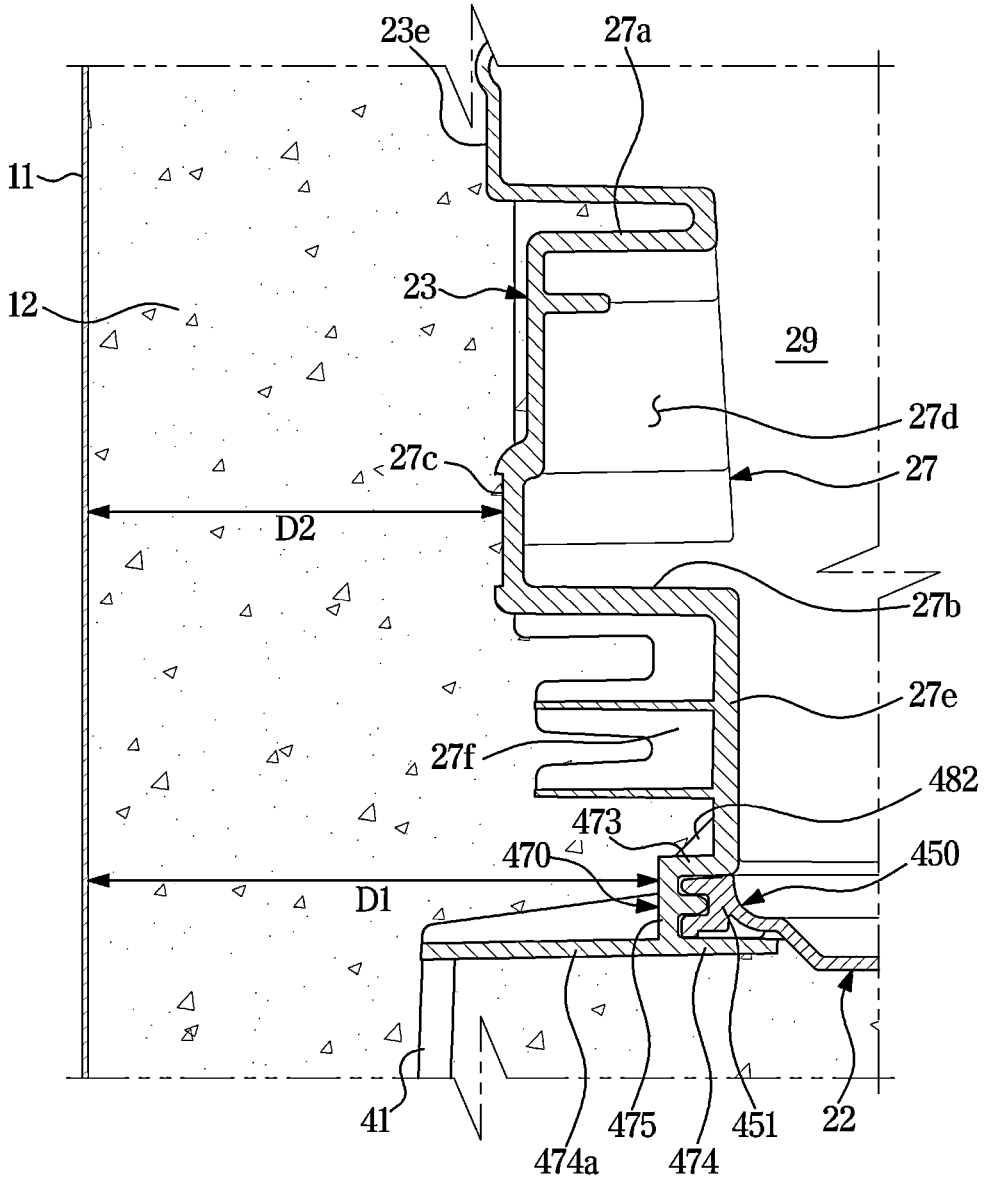
FIG. 20 is an enlarged view showing a portion H of FIG. 19.
Figure 21:
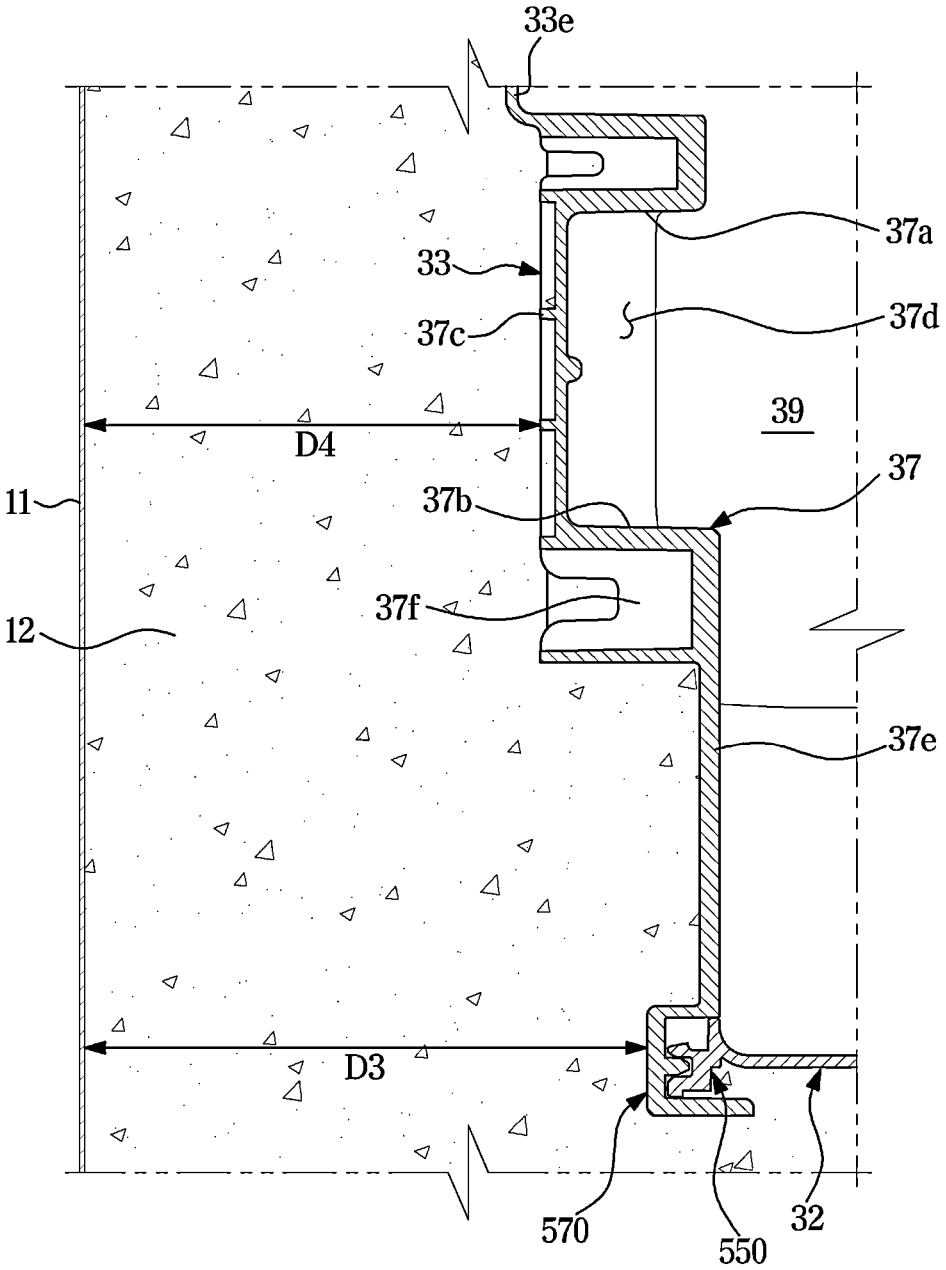
FIG. 21 is an enlarged view showing a portion I of FIG. 19.

FIG. 19 is a front cross-sectional view showing an inner case and an outer case of a refrigerator according to an embodiment of the disclosure. FIG. 20 is an enlarged view showing a portion H of FIG. 19. FIG. 21 is an enlarged view showing a portion I of FIG. 19.

A relation between the rail 27 formed in the left plate 23 of the first inner case 20 and the coupling portions of the left plate 23 and the lower plate 22 of the first inner case 20 will be described with reference to FIGS. 19 and 20. Because the left plate 23 and the right plate 24 of the first inner case 20 are symmetrical to each other and are the substantially same, the following description may be applied in the same way to the rail 27 formed in the right plate 24 of the first inner case 20 and the coupling portions of the right plate 24 and the lower plate 22 of the first inner case 20.

As described above, the rail 27 (see FIGS. 3 and 20) slidably supporting the storage container 14 (see FIG. 1) may be formed on the left plate 23.

More specifically, the rail 27 may include an upper rail portion 27*a* protruding from an inner surface of a left plate body 23*e*, a lower rail portion 27*b* protruding from the inner surface of the left plate body 23*e* and positioned below the upper rail portion 27*a*, a rail side portion 27*c* connecting the upper rail portion 27*a* to the lower rail portion 27*b*, a rail groove 27*d* formed between the upper rail portion 27*a* and the lower rail portion 27*b* such that a container rail portion (not shown) of the storage container 14 is slidably inserted in the rail groove 27*d*, and a rail supporting portion 27*e* extending downward from the lower rail portion 27*b*.

A rail reinforcing rib 27*f* for reinforcing strength of the rail 27 may be formed on outer surfaces of the lower rail portion 27*b* and the rail supporting portion 27*e*.

To couple an edge of the lower plate 22 with an edge of the left plate 23, a first coupling portion 450 may be formed in the edge of the lower plate 22, and a second coupling portion 470 may be formed in the edge of the left plate 23.

The first coupling portion 450 may include an insertion protrusion 451. The second coupling portion 470 may include an accommodating portion forming an accommodating groove in which the insertion protrusion 451 is inserted.

The accommodating portion may include a first wall 473, a second wall 474, and a third wall 475. The first wall 473, the second wall 474, and the third wall 475 may form the accommodating groove. The first wall 473 may be opposite to the second wall 474. The third wall 475 may connect the first wall 473 to the second wall 474.

The second coupling portion 470 may include an outer rib 482 provided on an outer side of the accommodating portion 471 and supporting the first wall 473. The outer rib 482 may connect an outer surface of the first wall 473 to the rail supporting portion 27*e* of the rail 27. The outer rib 482 may be formed in a shape of a triangle.

The second wall 474 may include a second wall extension portion 474*a* protruding from an outer end of the second wall 474 toward the insulation 12. The second wall extension portion 474*a* may protrude more outward than the left plate body 23*e*. The extension panel 41 (see FIGS. 3 and 20) may extend downward from an end of the second wall extension portion 474*a*.

The second coupling portion 470 may be formed below the rail 27 of the left plate 23, while being adjacent to the rail 27. More specifically, the first wall 473 may extend from a lower end of the rail supporting portion 27*e* of the rail 27 toward the insulation 12.

Also, a length D1 between the outer case 11 and the coupling portions 450 and 470 may be longer than a length D2 between the outer case 11 and the rail 27. That is, the first and second coupling portions 450 and 470 may be positioned at an inner side than the rail side portion 27*c*.

Accordingly, a thickness of the insulation 12 between the outer case 11 and the first and second coupling portions 450 and 470 may be greater than a thickness of the insulation 12 between the outer case 11 and the rail side portion 27*c*.

As such, because the first and second coupling portions 450 and 470 do not protrude toward the insulation 12, the thickness of the insulation 12 may be not reduced by the first and second coupling portions 450 and 470, which secures a sufficient insulation thickness. Accordingly, it may be possible to prevent a dew formation defect or an increase of power consumption, which is caused by an insulation thickness reduction.

A rail 37 formed in the left plate 33 of the second inner case 30, and the coupling portions 550 and 570 formed in the left plate 33 and the lower plate 32 of the second inner case 30 will be described with reference to FIG. 21.

A relation between the rail 37 and the coupling portions 550 and 570 of the second inner case 30 may be the same as the relation between the rail 27 and the coupling portions 450 and 470 of the first inner case 20.

That is, the rail 37 (see FIGS. 15 and 21) slidably supporting the storage container 14 may be formed on an inner surface of the left plate 33, and the second coupling portion 570 may be formed below the rail 37 of the left plate 33, while being adjacent to the rail 37.

The rail 37 may include an upper rail portion 37*a* protruding from an inner surface of the left plate body 33*e*, a lower rail portion 37*b* protruding from the inner surface of the left plate body 33*e* and positioned below the upper rail portion 37*a*, a rail side portion 37*c* connecting the upper rail portion 37*a* to the lower rail portion 37*b*, a rail groove 37*d* formed between the upper rail portion 37*a* and the lower rail portion 37*b* such that a container rail portion (not shown) of the storage container 14 is slidably inserted in the rail groove 37*d*, and a rail supporting portion 37*e* extending downward from the lower rail portion 37*b*.

A rail reinforcing rib 37*f* for reinforcing strength of the rail 37 may be formed on outer surfaces of the lower rail portion 37*b* and the rail supporting portion 37*e*.

The second coupling portion 570 may extend from a lower end of the rail supporting portion 37*e* of the rail 37.

Also, a length D3 between the outer case 11 and the coupling portions 550 and 570 may be longer than a length D4 between the outer case 11 and the rail 37. That is, the coupling portions 550 and 570 may be positioned at an inner side than the rail side portion 37*c*.

Accordingly, a thickness of the insulation 12 between the outer case 11 and the coupling portions 550 and 570 may be greater than a thickness of the insulation 12 between the outer case 11 and the rail side portion 37*c*.

Figure 22:
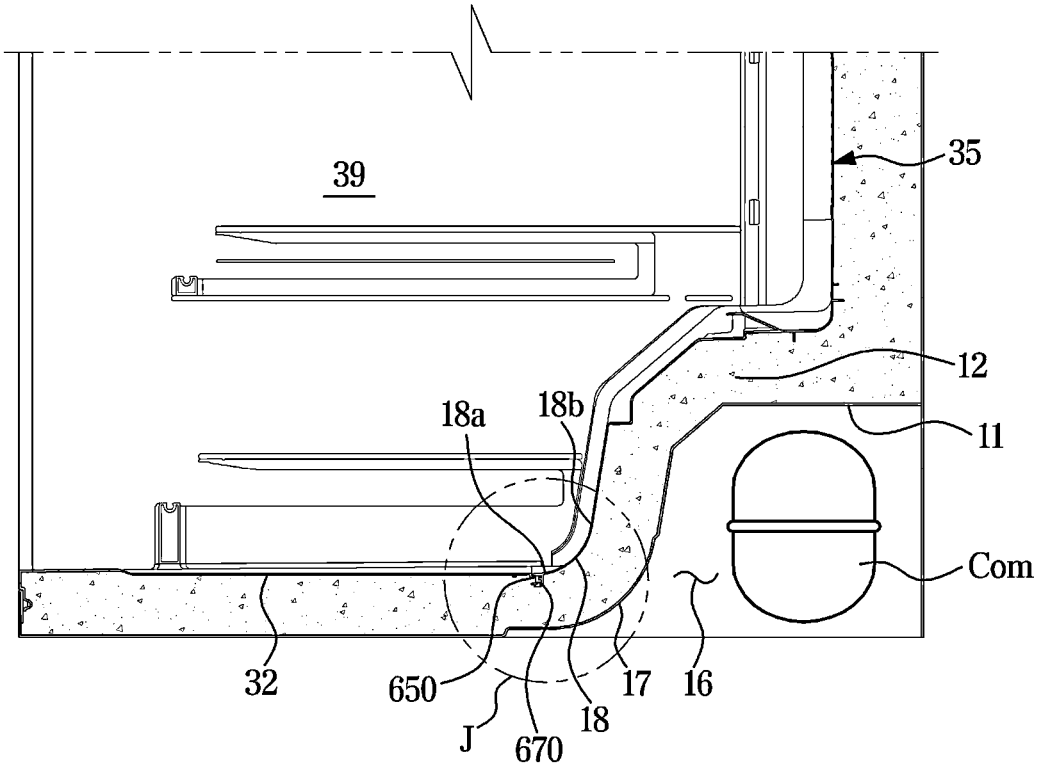
FIG. 22 is a side cross-sectional view showing an inner case and an outer case of a lower portion of a refrigerator according to an embodiment of the disclosure.
Figure 23:
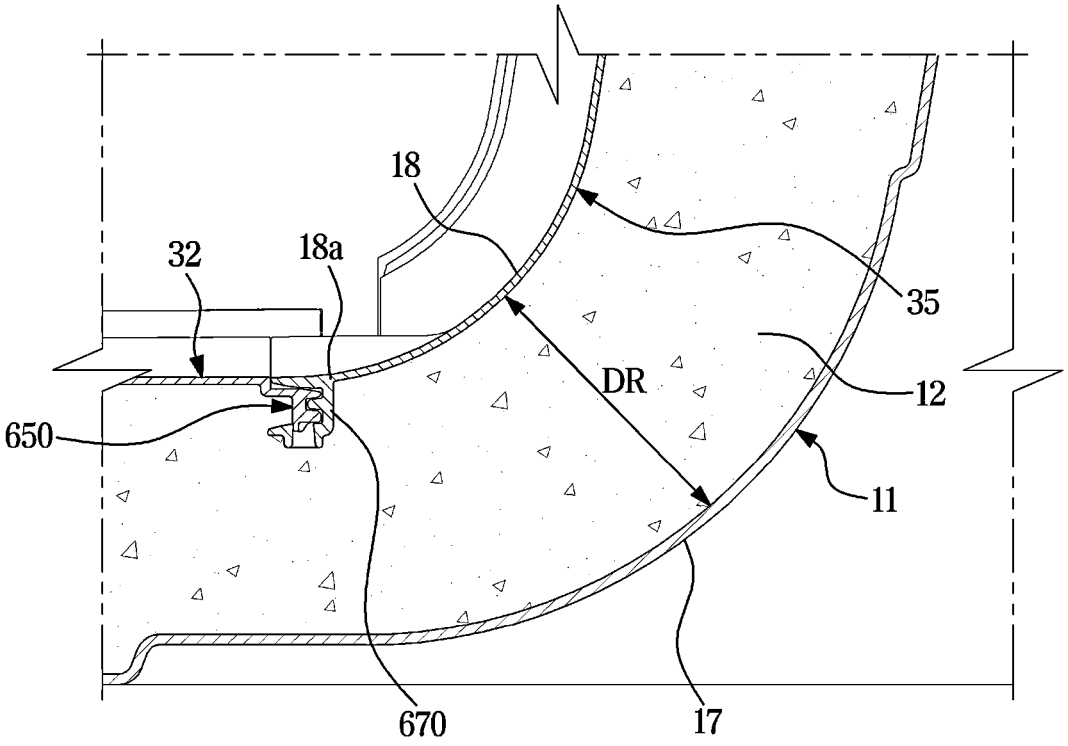
FIG. 23 is an enlarged view showing a portion J of FIG. 22.

FIG. 22 is a side cross-sectional view showing an inner case and an outer case of a lower portion of a refrigerator according to an embodiment of the disclosure. FIG. 23 is an enlarged view showing a portion J of FIG. 22.

A structure of the coupling portions of the lower plate 32 and the rear plate 35 of the second inner case 30, according to an embodiment of the disclosure, will be described with reference to FIGS. 22 and 23.

A machine room 16 in which a compressor Com for compressing a refrigerant, etc. are accommodated may be formed in a rear, lower space of the main body 10. The machine room 16 may be insulated from the storage room 39 by the insulation 12.

The outer case 11 may include an outer case round portion 17 rounded convexly toward the machine room 16 in front of the machine room 16. Also, the inner case 30 may include an inner case round portion 18 rounded to correspond to the outer case round portion 17.

A thickness DR between the outer case round portion 17 and the inner case round portion 18 may be substantially constant between a start point 18*a* and an end point 18*b* of the inner case round portion 18.

Also, the coupling portions 650 and 670 of the lower plate 32 and the rear plate 35 may be positioned at the start point 187*a* of the inner case round portion 18. For this, the inner case round portion 18 may be formed in the rear plate 35. The inner case round portion 18 may extend in a rear upper direction from the coupling portion 670.

Because the coupling portions 650 and 670 of the lower plate 32 and the rear plate 35 are positioned at the start point 18*a* of the inner case round portion 18, a reduction in thickness of the insulation 12 between the outer case round portion 17 and the inner case round portion 18 may be small, and a dew formation defect or an increase of power consumption, which is caused by a reduction of an insulation thickness, may be prevented.

Also, because the inner case round portion 18 is positioned in the rear plate 35 and the lower plate 35 is flat, the coupling portion 670 formed in an edge of the rear plate 35 may be easily assembled with the coupling portion 650 formed in an edge of the lower plate 32. That is, by moving the coupling portion 650 of the lower plate 32 in a horizontal direction toward the coupling portion 670 of the rear plate 35, the coupling portion 650 of the lower plate 32 may be coupled with the coupling portion 670 of the rear plate 35.

The structures of the inner cases according to the above-described embodiments of the disclosure may be applied to various home appliances, such as a clothes care apparatus, a shoe care apparatus, a cooking appliance, a dish washer, and an air conditioner, as well as a refrigerator.

That is, a home appliance may include a home appliance body having an inside space of which one side opens to perform a certain function, and a home appliance door coupled with the home appliance body to open or close the open side of the inside space. The home appliance body may include an inner case, an outer case, and an insulation provided between the inner case and the outer case, and the inner case according to the above-described embodiments of the disclosure may be applied to the inner case of the home appliance body.

According to a concept of the disclosure, an inner case of a refrigerator may be formed by assembling a plurality of plates formed by injection-molding.

According to a concept of the disclosure, it may be possible to prevent or reduce a gap between a plurality of plates assembled to form an inner case.

According to a concept of the disclosure, it may be possible to improve airtightness between a plurality of plates assembled to form an inner case.

According to a concept of the disclosure, it may be possible to prevent a reduction of an insulation thickness, dew formation, an increase of power consumption, etc., which are caused by coupling portions of a plurality of plates forming an inner case.

Although the technical concept of the disclosure has been described based on specific embodiments, the scope of rights of the disclosure is not limited to these embodiments. It should be interpreted that various embodiments modified or changed by a person skilled in the art within a scope not deviating from the gist of the disclosure as the technical concept of the disclosure, which is defined in the claims, also belong to the scope of rights of the disclosure.

What is claimed is:

1. A refrigerator comprising:

an inner case forming a storage room and including a plurality of plates, each of the plurality of plates formed by injection-molding;

an outer case coupled to the inner case; and an insulation provided between the inner case and the outer case, wherein a first plate of the plurality of plates includes:

a first coupling portion extending along an edge of the first plate, the first coupling portion including:

an insertion protrusion extending along a length of the first coupling portion, the insertion protrusion including a rib groove, and a second plate of the plurality of plates includes:

a second coupling portion extending along an edge of the second plate and couplable with the first coupling portion, the second coupling portion including:

an accommodating portion extending along a length of the second coupling portion and having an accommodating groove into which the insertion protrusion is insertable, a catching portion in the accommodating groove and configured to prevent the insertion protrusion from departing from the accommodating groove upon insertion of the insertion protrusion into the accommodating groove, and an inner rib protruding from an inner surface of the accommodating portion toward the accommodating groove, and insertable into the rib groove of the insertion protrusion.

2. The refrigerator of claim 1, wherein the accommodating portion includes:

a first wall, a second wall being opposite to the first wall, and a third wall connecting the first wall to the second wall, and the inner rib protrudes from the third wall.

3. The refrigerator of claim 2, wherein the first wall protrudes from the second plate toward the insulation.

4. The refrigerator of claim 2, wherein the insertion protrusion is insertable into the accommodating groove in a first direction, and the inner rib protrudes along a second direction that is opposite to the first direction, the inner rib supported by the insertion protrusion along a fourth direction that is opposite to a third direction, the third direction being perpendicular to the first direction, upon thermal contraction of the second plate along the third direction.

5. The refrigerator of claim 1, wherein the inner rib extends along a longitudinal direction of the edge of the second plate.

6. The refrigerator of claim 2, wherein the insertion protrusion includes:

a first surface corresponding to the first wall, a second surface corresponding to the second wall, and a third surface corresponding to the third wall.

7. The refrigerator of claim 6, wherein the insertion protrusion includes a catching hook protruding from the second surface and configured to be caught by the catching portion.

8. The refrigerator of claim 6, wherein the rib groove is depressed into the third surface.

9. The refrigerator of claim 8, wherein the insertion protrusion includes:

a guide pin formed in the rib groove and configured to guide the insertion protrusion to be insertable into the accommodating groove, and the inner rib includes:

a guide groove into which the guide pin is insertable.

10. The refrigerator of claim 2, wherein the second coupling portion includes:

an outer rib connecting an outer surface of the second plate to an outer surface of the first wall, and supporting the first wall.

11. The refrigerator of claim 10, wherein the outer rib includes:

a first contact surface in contact with the outer surface of the second plate, a second contact surface in contact with the outer surface of the first wall, and an inclined surface connecting the first contact surface to the second contact surface.

12. The refrigerator of claim 10, wherein the outer rib is one outer rib of a plurality of outer ribs, and the plurality of outer ribs are spaced from each other along a longitudinal direction of the edge of the second plate.

13. The refrigerator of claim 2, wherein the first wall extends from the second plate.

14. The refrigerator of claim 1, wherein the first coupling portion includes:

an auxiliary protrusion extending in a direction perpendicular to a direction in which the insertion protrusion is insertable into the accommodating groove, and the second coupling portion includes:

a step portion stepped toward the insulation and configured to be in contact with the auxiliary protrusion upon insertion of the insertion protrusion into the accommodating groove.

15. The refrigerator of claim 1, wherein the insertion protrusion includes:

a catching hook configured to be caught by the catching portion, and the second coupling portion includes:

an elastic bracket in which the catching portion is formed, and a plurality of slits respectively formed on both sides of the elastic bracket to enable the elastic bracket to be elastically deformable, and the elastic bracket is configured to:

upon insertion of the insertion protrusion into the accommodating groove, be pressed by the catching hook and elastically deformed, and return to an original state after the insertion protrusion is inserted into the accommodating groove.

16. A refrigerator comprising:

an inner case forming a refrigerating room and including a plurality of plates, each of the plurality of plates formed by injection-molding;

an outer case coupled to the inner case; and an insulation provided between the inner case and the outer case, wherein a first plate of the plurality of plates includes:

a first coupling portion extending along an edge of the first plate, the first coupling portion including:

an insertion protrusion extending along a length of the first coupling portion, the insertion protrusion including a rib groove, and a second plate of the plurality of plates includes:

a second coupling portion extending along an edge of the second plate and couplable with the first coupling portion, the second coupling portion including:

an accommodating portion extending along a length of the second coupling portion and having an accommodating groove into which the insertion protrusion is insertable, the accommodating portion including a first wall, a second wall being opposite to the first wall, and a third wall connecting the first wall to the second wall, a catching portion in the accommodating groove and configured to prevent the insertion protrusion from departing from the accommodating groove upon insertion of the insertion protrusion into the accommodating groove, an inner rib protruding from an inner surface of the accommodating portion toward the accommodating groove, and insertable into the rib groove of the insertion protrusion, and an outer rib connecting the second plate to the first wall.

17. The refrigerator of claim 16, wherein the outer rib includes:

a first contact surface in contact with an outer surface of the second plate, a second contact surface in contact with an outer surface of the first wall, and an inclined surface connecting the first contact surface to the second contact surface.

18. The refrigerator of claim 16, wherein the outer rib is one outer rib of a plurality of outer ribs, and the plurality of outer ribs are spaced from each other along a longitudinal direction of the edge of the second plate.

19. The refrigerator of claim 16, wherein the first plate of the plurality of plates includes a rail configured to slidably support a storage container, a length from the outer case to the first coupling portion and the second coupling portion is greater than a length from the outer case to the rail.

20. The refrigerator of claim 16, wherein the inner case and the outer case define a main body; a machine room in a rear, lower space of the main body, and configured so that a compressor is installable in the machine room, and an inner case round portion rounded convexly toward the machine room and formed to extend from the second coupling portion.

* * * * *